US005548190A

United States Patent [19]

Okuyama et al.

[11] Patent Number: 5,548,190

[45] Date of Patent: Aug. 20, 1996

[54] DEFLECTION YOKE AND CATHODE-RAY TUBE APPARATUS COMPRISING THE SAME

[75] Inventors: Nobutaka Okuyama; Soichi Sakurai; Kooji Fukuma, all of Yokohama; Hiroshi Yoshioka, Mobara; Masao Obara, Yokohama; Naoki Ito, Kitakami; Atsushi Takeyama, Odawara; Yoshio Satoh, Chiba-ken, all of Japan

[73] Assignees: Hitachi, Ltd., Tokyo; Hitachi Media Electronics Co., Ltd., Iwate-ken, both of Japan

[21] Appl. No.: 533,994

[22] Filed: Sep. 27, 1995

[30] Foreign Application Priority Data

Sep. 28, 1994 [JP] Japan ..... 6-233328
Apr. 13, 1995 [JP] Japan ..... 7-088210

[51] Int. Cl.[6] ..... H01J 29/51; G09G 1/28

[52] U.S. Cl. ..... 315/368.26; 315/368.28

[58] Field of Search ..... 315/368.25, 368.26, 315/368.28; 313/412; 348/807

[56] References Cited

U.S. PATENT DOCUMENTS 5,070,280 12/1991 Okuyama et al. ..... 315/368.11
5,142,205 8/1992 Yabase et al. ..... 315/368.26
5,397,968 3/1995 Ito et al. ..... 315/368.28

FOREIGN PATENT DOCUMENTS 4-286841 10/1992 Japan .
6-108121 4/1994 Japan .
6-125474 5/1994 Japan .
6-284434 10/1994 Japan .

*Primary Examiner*—Theodore M. Blum
*Attorney, Agent, or Firm*—Antonelli, Terry, Stout & Kraus

[57] ABSTRACT

A color cathode-ray tube which includes a deflection yoke having a convergence correcting device and an electron gun provided to the deflection yoke for generating a multiplicity of electron beams. In the deflection yoke, a vertical deflection coil is made up of at least a pair of saddle type coil halves each divided into at least first and second coil parts, the first coil parts of the coil halves and the second coil parts thereof are connected respectively mutually in series or parallel, a subcore having a vertical auxiliary deflection coil is provided on a side of the electron gun, the vertical auxiliary deflection coil is made up of first and second correction coils for generating 4 polar magnetic field components which are directed at least opposite to each other, a series circuit of a first resistor and the first correction coil is connected in parallel to a series circuit of a second resistor and the second correction coil to form a parallel circuit, the parallel circuit is connected in series with the vertical deflection coil, a shunt circuit is provided for shunting a current flowing through the second coil part to supply the shunted current into the first and second correction coils to thereby cause a predetermined imbalance between the currents flowing through the first and second correction coils, when an area of a display screen other than a predetermined range in a vertical direction is subjected to a vertical deflection. Thereby horizontal and vertical line misconvergences can be corrected.

26 Claims, 25 Drawing Sheets

DEFLECTION YOKE AND CATHODE-RAY TUBE APPARATUS COMPRISING THE SAME

BACKGROUND OF THE INVENTION

1. Field of the Invention

The present invention relates to a deflection yoke for use in a color cathode-ray tube for forming a multiplicity of electron beams in an inline array and more particularly, to a deflection yoke having a convergence correcting means.

2. Description of the Related Art

An example of known deflection yokes having a convergence correcting means is disclosed, e.g., in JP-A-6-125474, in which a vertical deflection coil comprises a pair of coil halves each of which has a centertap and thus has first and second coil parts divided, the first coil parts of the pair of coil haves are connected at their coil ends to each other, a shunt circuit which impedance varies with a voltage between these centertaps of the coil halves is connected in parallel between the centertaps to thereby correct horizontal line misconvergences of upper and lower parts of a display screen.

In such a prior art, however, since the first and second coil parts are not separated from each other but connected to each other at their coil ends of the first coil parts of the coil half pair, when a current flowing through the shunt circuit connected between the centertaps is arranged to be passed through a correction coil to correct vertical line misconvergences of upper and lower ends of the display screen caused by the correction of the horizontal line misconvergences of the upper and lower parts of the screen, a current similar to the vertical deflection current cannot be made to flow through the correction coil.

This can be attained by providing a vertical auxiliary deflection coil for causing the current similar to the vertical deflection current to flow through the correction coil, but this disadvantageously requires a large space necessary for winding the auxiliary deflection coil around a subcore.

Further, since the winding position of the first coil part cannot be freely selected, there is another problem that the vertical line misconvergences caused by the correction of the horizontal line misconvergences of the screen upper and lower parts becomes larger at the upper and lower parts of the screen left and right ends than the vertical line misconvergences at the upper and lower parts of the screen central area.

Furthermore, since the shunt circuit, which impedance varies with the voltage appearing across the centertaps, is made up of only diodes which are conducted when subjected to a predetermined voltage or a higher voltage, left/right pincushion distortion can be corrected only at the screen upper and lower parts but remains in the screen central zone, which disadvantageously results in that left/right distortion performance is deteriorated.

In addition, for the purpose of adjusting the correction amount of the vertical line misconvergences of the screen upper and lower parts, this requires provision and adjusting operation of separate variable resistors for the respective upper and lower parts.

SUMMARY OF THE INVENTION

It is therefore a first object of the present invention to provide a deflection yoke which can eliminate the problems in the prior art and in which a correction current for horizontal line misconvergences at upper and lower ends of a display screen can flow through a correction coil for vertical line misconvergences at upper and lower parts of the screen and the correction coil can function also as a vertical auxiliary deflection coil through which a vertical deflection current (or a current similar to the vertical deflection current) flows, and also to provide a color cathode-ray tube apparatus having the deflection yoke.

A second object of the present invention is to provide a deflection yoke wherein vertical line misconvergences caused by correction of horizontal line misconvergences at upper and lower ends of a display screen can be made to be substantially equal both at upper and lower part of a screen center area and at upper and lower parts of screen left and right ends and a correction coil can allow simultaneous correction of the vertical line misconvergences at the lower parts of the screen central area and at the upper and lower parts of the screen left and right ends, and also to provide a color cathode-ray tube apparatus having the deflection yoke.

A third object of the present invention is to provide a deflection yoke wherein correction of horizontal line misconvergences at upper and lower parts of a display screen can be carried out without causing any deterioration of vertical line misconvergences at upper and lower ends of the screen and left/right distortion performances and a correction coil for the misconvergence correction can function as a vertical auxiliary deflection coil through which a vertical deflection current (or a current similar to the vertical deflection current) flows, and also to provide a color cathode-ray tube apparatus having the deflection yoke.

A fourth object of the present invention is to provide a deflection coil which can correct such a phenomenon as vertical line misconvergences that a distance between vertical lines between upper and lower ends of a display screen and a screen center is not constant, and also to provide a color cathode-ray tube apparatus having the deflection yoke.

A fifth object of the present invention is to provide a deflection yoke in which adjustment of correction in vertical line misconvergences at upper and lower parts of a display screen can be carried out simultaneously with use of a single adjusting means, and also to provide a color cathode-ray tube apparatus having the deflection yoke.

In accordance with an aspect of the present invention, the above first object can be attained by providing a deflection yoke wherein a vertical deflection coil is made up of at least a pair of saddle shaped coil halves each divided into at least 2 first and second coil parts, the first coil parts of the coil halves and the second coil parts thereof are connected respectively in series or in parallel, a subcore having a vertical auxiliary deflection coil is provided on a side of an electron gun, the vertical auxiliary deflection coil includes first and second correction coils for generating at least 4 polar magnetic field components directed opposite to each other, a series circuit of a first resistor and the first correction coil is connected in parallel to a series circuit of a second resistor and the second correction coil to form a parallel circuit, the parallel circuit is connected in series with the vertical deflection coil, a shunt circuit is provided for shunting a current flowing through the second coil part to supply the shunted current into the first and second correction coils (with a sum of the currents flowing through the first and second correction coils being substantially similar to the vertical deflection coil) to thereby cause a predetermined imbalance between the currents flowing through the first and second correction coils, when an area of a display screen other than a predetermined range (vertical size) in a vertical direction is subjected to a vertical deflection.

In accordance with another aspect of the present invention, the above second object can be attained by providing a deflection yoke wherein a vertical deflection coil is made up of at least a pair of saddle shaped coil halves each divided into at least 3 first, second and third coil parts, the second coil parts of the coil halves are disposed between the first and third coil parts, the second coil part is connected to a circuit of the first and third coil parts, an impedance circuit having a negative temperature coefficient is connected in series with the second coil part, and a shunt circuit which impedance varies with a voltage is connected to the series-connected circuit.

In accordance with a further aspect of the present invention, the above third object can be attained by providing a deflection yoke wherein a series circuit of a first impedance circuit and the first correction coil is connected in parallel to a series circuit of a second impedance circuit and the second correction coil to form a parallel circuit, the parallel circuit is connected in series with the vertical deflection coil, a current flowing through the second coil part is shunted through a plurality of shunt circuits according to a vertical deflection current, the shunted currents are supplied from the shunt circuits to a junction point of the first impedance circuit and first correction coil and a junction point of the second impedance circuit and second correction coil (a total of the currents flowing through the first and second correction coils being substantially similar to the vertical deflection current), thus causing a predetermined imbalance between the currents flowing through the first and second correction coils.

In accordance with yet a further aspect of the present invention, the above fourth object can be attained by providing a deflection yoke wherein a resistor series circuit having 2 or more resistor connected in series is connected between a junction point of the first impedance circuit and first correction coil and a junction point of the second impedance circuit and second correction coil, and third and fourth shunt circuits are connected to any ones of intermediate connection points provided between the resistors of the resistor series circuit.

In accordance with yet another aspect of the present invention, the above fifth object can be attained by providing a deflection yoke wherein a variable resistor is connected between the junction point of the first impedance circuit and first correction coil and the junction point of the second impedance circuit and second correction coil.

With the arrangement for attaining the first object, when a predetermined size of screen is subjected to a vertical deflection, the current flowing through the second coil part of the vertical deflection coil is decreasedly shunted through the shunt circuit, whereby horizontal line misconvergences at the screen upper and lower parts are corrected and an imbalance corresponding to the shunt current flowing through the shunt circuit takes place between the currents flowing through the first and second correction coils. Thus, vertical line misconvergences at the screen upper and lower parts caused by the correction of the horizontal line misconvergences is also corrected, and further an auxiliary vertical deflection magnetic field is established so long as a sum of the currents flowing through the first and second correction coils is equal (or substantially similar) to the vertical deflection current.

With the arrangement for attaining the second object, since the second coil part can be located at any position between the first and third coil parts, the vertical line misconvergences caused by the correction of the horizontal line misconvergences at the screen upper and lower parts can be made substantially equal at the center of the screen upper and lower parts and at the left and right ends of the screen upper part. Further, the correction coils enables simultaneous correction of these vertical line misconvergences.

With the arrangement for attaining the third object, since the current flowing through the second coil part of the vertical deflection coil due to a change in the vertical deflection current causes a smooth change of the shunt current flowing through the shunt circuit, the shape of a vertical deflection magnetic field gradually varies with the change of the vertical deflection current, whereby the horizontal line misconvergences at the screen upper and lower parts can be corrected without causing deterioration of left/right distortion performances. Further, since an imbalance corresponding to the shunt current takes place between the currents flowing through the first and second correction coils, the vertical line misconvergences caused by the correction of the horizontal line misconvergences at the screen upper and lower parts can be corrected. Furthermore, since a sum of the currents flowing through the first and second correction coils is made equal (or similar) to the vertical deflection current, an auxiliary vertical deflection magnetic field can be established.

With the arrangement for attaining the fourth object, since a correction and correction direction in the vertical line misconvergence between the screen upper and lower ends and the screen center can be set by the third and fourth shunt circuits independently of the correction of the vertical line misconvergences at the screen upper and lower ends, a phenomenon or vertical line misconvergence can be corrected that vertical lines are extended in a mutually divergent relation between the screen upper and lower ends and the screen center.

With the arrangement for attaining the fifth object, since a ratio between the currents flowing through the first and second correction coils can be changed by adjusting the single variable resistor without substantially changing the magnitude of the current flowing through the shunt circuit and regardless of the direction of the current flowing through the shunt circuit.

BRIEF DESCRIPTION OF THE DRAWINGS

Preferred embodiments of the present invention will now be described in conjunction with the accompanying drawings, in which.

DESCRIPTION OF THE PREFERRED EMBODIMENTS

Embodiments of the present invention will be explained with reference to the accompanying drawings.

Figure 1:
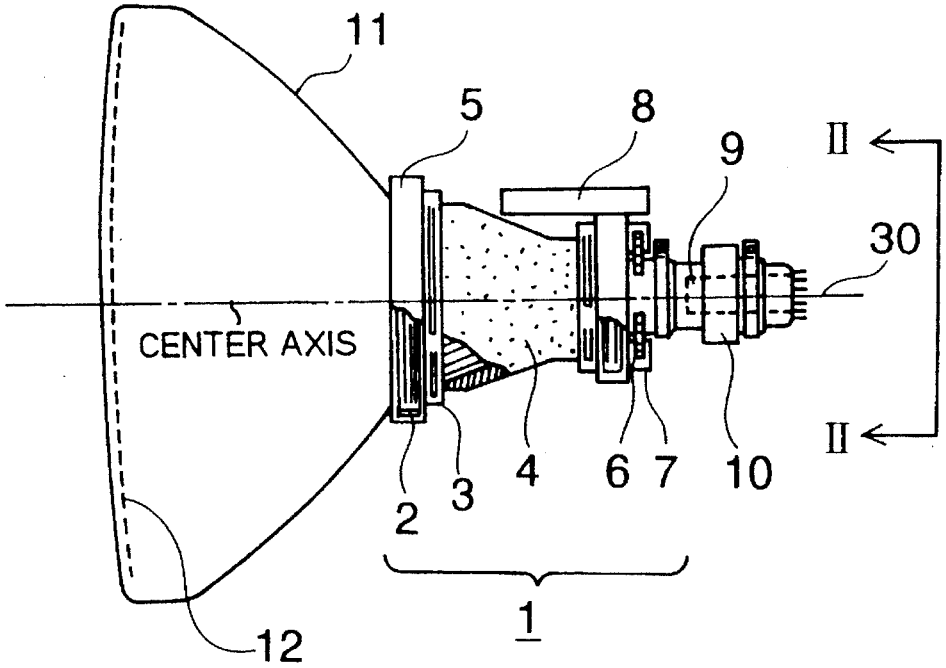
FIG. 1 is a partially broken side view of a color cathode-ray tube apparatus comprising a deflection yoke in accordance with the present invention.

Referring first to FIG. 1, there is shown a side view of a color cathode-ray tube apparatus having a deflection yoke in accordance with the present invention which includes a deflection yoke 1 in accordance with the present invention, a horizontal deflection coil 2, a vertical deflection coil 3, a main core 4, a separator 5, a subcore 6, a vertical auxiliary deflection coil 7, a terminal plate cover 8, an electron gun 9, a static convergence magnet 10, a color cathode-ray tube 11 and a phosphor screen 12.

In FIG. 1, the deflection yoke 1 is installed at a neck portion of the color cathode-ray tube 11 at a front side of which the phosphor screen 12 is provided, and the electron gun 9 having a function of forming a multiplicity of electron beams in an inline array is attached to a tip end of the color cathode-ray tube 11. The deflection yoke 1 is made up of the horizontal deflection coil 2 and the vertical deflection coil 3, which coils are both of a saddle type and which are surrounded at their circumferences by the main core 4 made of a magnetic material. The subcore 6, around which the vertical auxiliary deflection coil 7 is wound, is provided at one side of the deflection yoke 1 located next to the electron gun 9.

Figure 2:
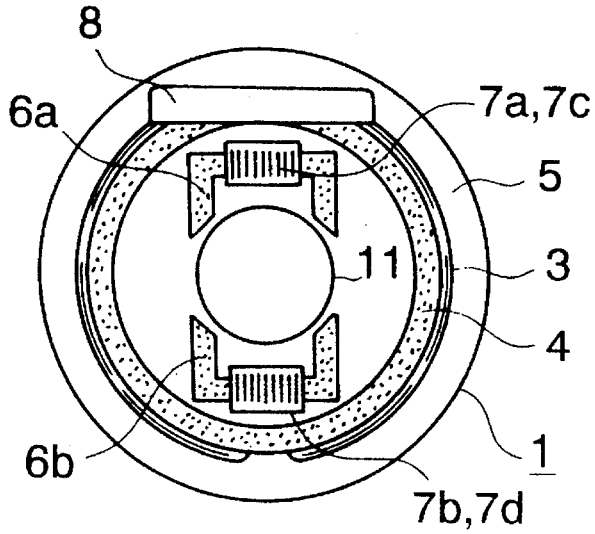
FIG. 2 is a rear view of a vertical auxiliary deflection coil in a first embodiment of the deflection yoke in accordance with the present invention.

Shown in FIG. 2 is a rear view of the vertical auxiliary deflection coil 7 as viewed from a II—II direction in a deflection yoke in accordance with a first embodiment of the present invention, which includes subcore members 6*a* and 6*b*, upper side coil parts 7*a* and 7*c*, lower side coil parts 7*b* and 7*d*, parts corresponding to those in FIG. 1 are denoted by the same reference numerals.

In FIG. 2, the subcore 6 (see FIG. 1) is made up of two subcore members 6*a* and 6*b* of U-shaped magnetic material disposed to hold the color cathode-ray tube 11 therebetween in a vertically opposing relation, the subcore members 6*a* and 6*b* being made of a soft magnetic material plate such as sintered ferrite or silicon steel.

Wound around the subcore member 6*b* are the lower side coil parts 7*b* and 7*d* which form the vertical auxiliary deflection coil 7.

It is preferable that the upper and lower side core parts 7*a* and 7*b* are disposed on the upper and lower sides of a central axis 30 of the color cathode-ray tube 11.

Figure 3A:
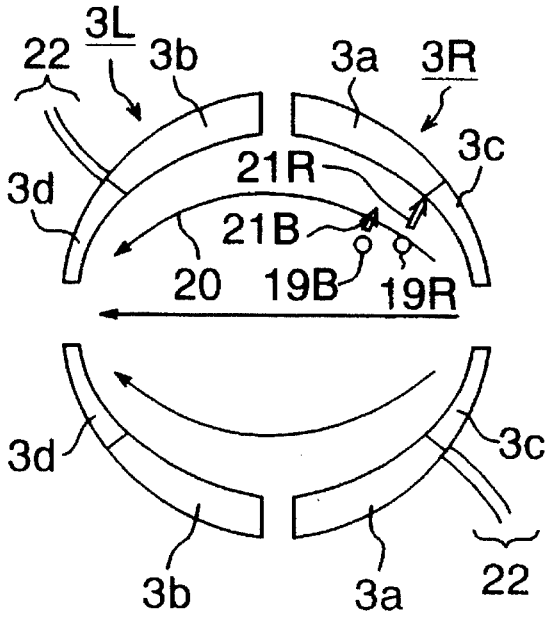
FIG. 3A PRIOR ART
FIGS. 3A and 3B show a structure of the vertical deflection coil of the first embodiment of the deflection yoke of the present invention as well as a structure of a corresponding coil in a prior art for comparison of vertical deflection magnetic field.
Figure 3B:
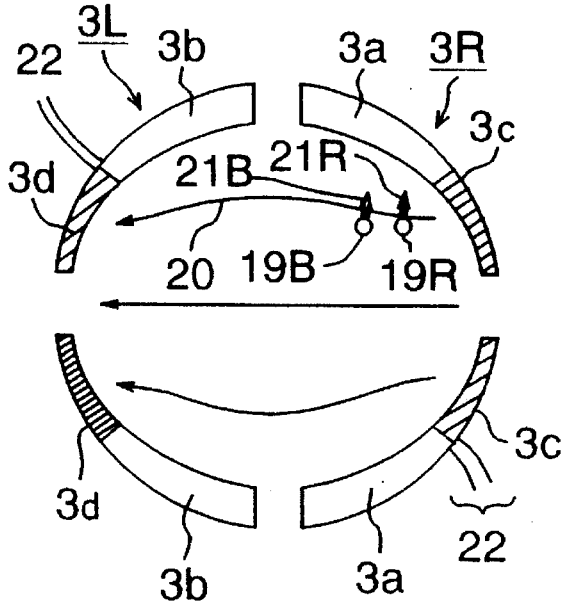

FIGS. 3A and 3B are cross-sectional views of a structure of the vertical deflection coil 3 of the first embodiment of the deflection yoke 1 of the present invention in FIG. 1 as well as of a structure of a corresponding coil in a prior art for comparison therebetween, as viewed from one side of the color cathode-ray tube 11 next to the phosphor screen 12, which include a right-side coil half 3R, a left-side coil half 3L, first coil parts 3*a* and 3*b*, second coil parts 3*c* and 3*d*, electron beams 19R (R meaning red and this holding true for symbols appearing hereinafter) and 19B (B meaning blue and this holding true for symbols appearing hereinafter), a vertical deflection magnetic field 20, deflection forces 21R and 21B, and a centertap 22.

In FIGS. 3A and 3B, the vertical deflection coil 3 (see FIG. 1) is made of the right-side coil half 3R and two saddle type coil halves of the left-side coil half 3L. The right-side coil half 3R, on the other hand, is provided with the centertap 22 so as to be divided into the first coil part 3*a* and the second coil part 3*c;* whereas, the left-side coil half 3L is also provided with the centertap 22 so as to be divided into the first coil part 3*b* and the second coil part 3*d*. In the respective coil halves 3R and 3L, the second coil parts 3*c* and 3*d* are located inside the first coil parts 3*a* and 3*b*.

Figure 4:
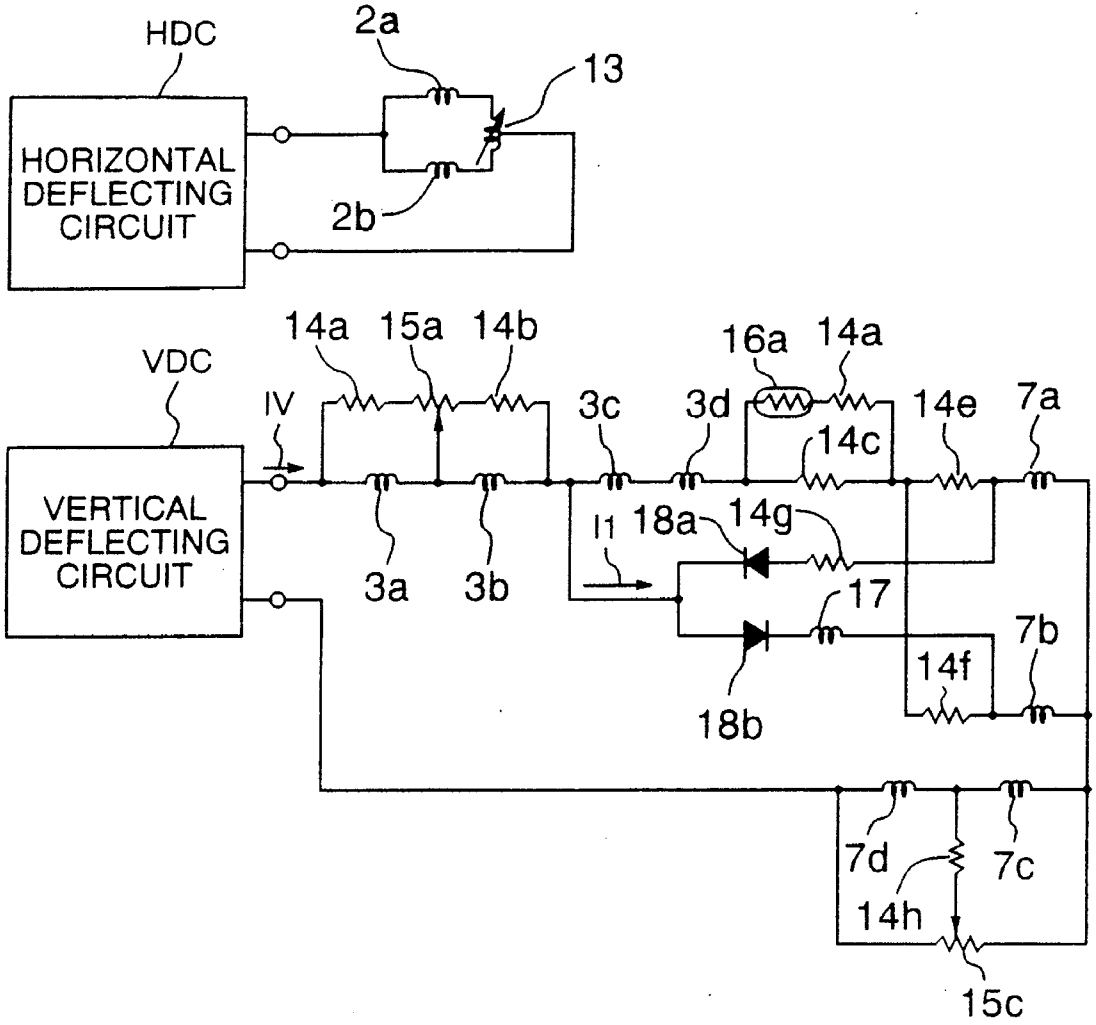
FIG. 4 is a circuit diagram of the first embodiment of the deflection yoke in accordance with the present invention.

FIG. 4 shows a circuit diagram showing how the respective coils are wired, which includes horizontal deflection coil parts 2*a* and 2*b*, a variable inductor 13, fixed resistors 14*a* to 14*h*, variable resistors 15*a* and 15*b*, a thermistor 16*a*, an inductor 17, diodes 18*a* and 18*b*, a horizontal deflection circuit HDC, a vertical deflection circuit VDC, parts corresponding to those in the previous drawings already explained above are denoted by the same reference numerals or symbols.

Figure 5A:
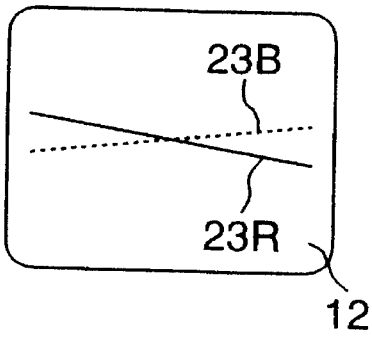
FIGS. 5A, 5B and 5C are convergence pattern diagrams for explaining the operation of the first embodiment of the deflection yoke in accordance with the present invention.

In FIG. 4, the horizontal deflection circuit HDC is connected at its one terminal with one terminals of the horizontal deflection coil parts 2*a* and 2*b*, which in turn are connected at the other terminals with the variable inductor 13. The variable inductor 13 is provided therein with a centertap which is connected to the other terminal of the horizontal deflection circuit HDC. The variable inductor 13 is used to adjust the balance between currents flowing through the horizontal deflection coil parts 2*a* and 2*b* by changing inductances between the centertap and the terminals of the horizontal deflection coil parts 2*a* and 2*b*. This inductor is usually provided for the purpose of correcting a misconvergence between horizontal lines 23B and 23R formed by such side electron beams as shown in FIG. 5A. In this connection, a center electron beam and horizontal and vertical lines formed thereby are omitted in the drawings.

Connected to the vertical deflection circuit VDC in series are the first coil parts 3*a* and 3*b* of the vertical deflection coil 3, the second coil parts 3*c* and 3*d* of the vertical deflection coil 3, a parallel circuit of 2 series circuits (one of which has the fixed resistor 14*e* and the upper side coil part 7*a* of the vertical auxiliary deflection coil 7 and the other has the fixed resistor 14*f* and the lower side coil part 7*b* of the vertical auxiliary deflection coil 7), the upper side coil part 7*c* of the vertical auxiliary deflection coil 7, and the lower side coil part 7*d* of the vertical auxiliary deflection coil 7, in this order.

Figure 5B:
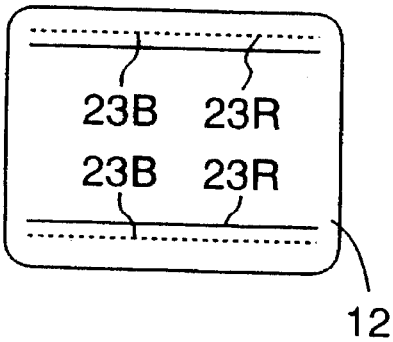

Connected in parallel to the first coil parts 3*a* and 3*b* is a series circuit of the fixed resistor 14*a*, variable resistor 15*a* and fixed resistor 14*b*. The variable resistor 15*a* has a variable terminal which is connected to a junction point between the first coil parts 3*a* and 3*b*. Accordingly, the first coil parts 3*a*, 3*b*, the fixed resistors 14*a*, 14*b* and the variable resistor 15*a* are comprised of a bridge circuit so that adjustment of the variable resistor 15*a* allows control of balance between currents flowing through the first coil parts 3*a* and 3*b*, thereby enabling correction of a misconvergence between the horizontal lines 23B and 23R formed by such side electron beams as shown in FIG. 5B. In this connection, such a convergence adjusting means may be provided or may be eliminated as necessary.

Connected in parallel with the fixed resistor 14*c* is a series circuit of the thermistor 16*a* and fixed resistor 14*d* to form a parallel circuit as an impedance circuit. This series circuit has a resistive value of a negative temperature coefficient. A series circuit of the fixed resistor 14*e* and the upper side core part 7*a* of the vertical auxiliary deflection coil 7 is connected in parallel with a series circuit of the fixed resistor 14*f* and the lower side coil part 7*b* of the vertical auxiliary deflection coil 7 to form a parallel circuit, which in turn is connected in series with the aforementioned impedance circuit.

Further connected in parallel to a series circuit of the upper- and lower-side coil parts 7*c* and 7*d* is the variable resistor 15*b* which variable terminal is connected through the fixed resistor 14*h* to a junction point between the upper- and lower-side coil parts 7*c* and 7*d*.

Figure 5C:
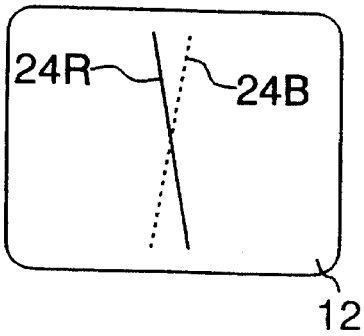

Accordingly, the upper- and lower-side coil parts 7*c* and 7*d*, fixed resistor 14*h*, and variable resistor 15*b* form a bridge circuit, so that through adjustment of balance between currents flowing through the upper- and lower-side coil parts 7*c* and 7*d*, a misconvergence between vertical lines 24B and 24R formed by such both end electron beams as shown in FIG. 5C can be corrected.

Further connected in parallel to a series circuit of the second coil parts 3*c*, 3*d*, aforementioned impedance circuit and fixed resistor 14*e* is a series circuit as a first shunt circuit of the diode 18*a* and fixed resistor 14*g*, the diode 18*a* being connected at its cathode to a junction point between the first and second coil parts 3*c* and 3*d*. Connected in parallel to a series circuit of the second coil parts 3*c*, 3*d*, aforementioned impedance circuit and fixed resistor 14*f* is a series circuit as a second shunt circuit of the diode 18*b* and inductor 17, the diode 18*b* being connected at its anode to a junction point between the first and second coil parts 3*b* and 3*c*.

Although the first coil parts 3*a*, 3*b* and the second coil parts 3*c* and 3*d* are connected respectively in series in the configuration of FIG. 4, there may be considered such another arrangement that the first coil parts 3*a* and 3*b* are connected in parallel while the second coil parts 3*c* and 3*d* are in parallel. This explanation holds true even for the first and second coil parts in the respective embodiments.

In the first shunt circuit, the flowing direction or sense of a shunt current I1 depends on the polarity of the diode 18*a*, that is, the shunt current I1 flows in a direction opposite to its arrow direction when the lower part of the screen is subjected to a vertical deflection. In the second shunt circuit, meanwhile, the flowing direction or sense of the shunt current I1 depends on the polarity of the diode 18*a*, that is, the shunt current I1 flows in a direction shown by its arrow when the upper part of the screen is subjected to the vertical deflection.

Figure 6A:
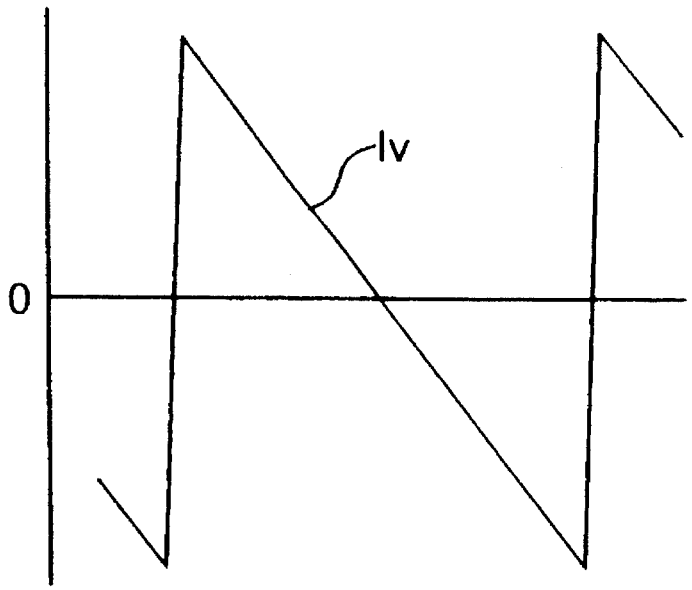
FIGS. 6A and 6B show diagrams of waveforms of a vertical deflection current and its shunt current in FIG. 4.
Figure 6B:
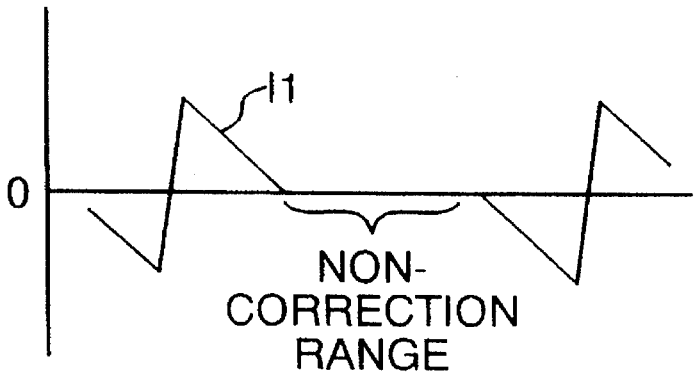

Such a vertical deflection current Iv as shown in FIG. 6, (*a*), which is output from the vertical deflection circuit VDC, flows through the first coil parts 3*a* and 3*b*. More in detail, in the upper and lower parts of the screen requiring the correction of the misconvergence, the vertical deflection current Iv flows partly through a shunt circuit including the diode 18*b* or 18*a* as the shunt current I1, while the remaining current flows through the second coil parts 3*c* and 3*d*. As shown in FIG. 6, (*b*), the shunt current I1 is substantially zero in such a range that the vertical deflection current Iv is smaller than ½ of its maximum amplitude the vertical deflection of the electron beam is small with unnoticeable misconvergence (, which range corresponds to a central part of the screen in a vertical direction and which will be referred to as the non-correction range, hereinafter). In this conjunction, though the non-correction range is set in the illustrated example to be between ±½ the maximum amplitude of the vertical deflection current Iv, the present invention is not limited to the specific example. When the shunt current I1 goes into ranges (corresponding to the upper and lower parts of the screen) other than the non-correction range, in which the vertical deflection current Iv is larger than ½ its maximum amplitude and the vertical deflection is great; the shunt current I1 increases or decreased with the increased or decreased vertical deflection current. This is because the diode 18*a* or 18*b* is arranged to be conducted when the amplitude of the vertical deflection current Iv becomes higher than ½ of its maximum amplitude so that a forward voltage is applied to the diode 18*a* or 18*b*. There may be considered such an arrangement that a current substantially similar to the vertical deflection current Iv issued from the vertical deflection circuit VDC is applied to the first coil part 3*a* and 3*b*, which holds true for the respective embodiments.

The impedance varies with a voltage developed in a series circuit of the second coil parts 3*c*, 3*d*, aforementioned impedance circuit, and fixed resistor 14*e* or with a voltage developed in a series circuit of the second coil parts 3*c*, 3*d*, aforementioned impedance circuit and fixed resistor 14*f*, in such a manner that the diode 18*a* or 18*b* produces a constant voltage when applied with the forward voltage.

When the vertical deflection current Iv has a positive polarity and an amplitude of more than ½ its maximum amplitude to cause the upper part of the screen to be subjected to a vertical deflection, a large voltage developed in the second coil part 3*c*, 3*d* during the vertical retrace time causes an abnormal current containing pulses to appear in the positive side of the shunt current I1. This abnormal current, however, is suppressed by the inductance action of the inductor 17. Further, when the internal resistive value of the inductor 17 is optimumly set, the shunt current I1 can be linearly decreased.

When the vertical deflection current Iv has a negative amplitude of more than ½ its maximum amplitude to cause the lower part of the screen to be subjected to a vertical deflection, optimization of the resistive value of the fixed resistor 14*g* enables the negative amplitude of the shunt current I1 to be set at a predetermined value.

In such a prior art deflection yoke as shown in FIG. 3A, the vertical deflection magnetic field 20 is of such a stronger barrel shape as illustrated in the drawing; whereas, in such an embodiment as shown in FIG. 3B, a current flowing through the second coil parts 3*c* and 3*d* (hatched areas in the drawing) produce the vertical deflection magnetic field 20 of a weaker barrel shape because the current is decreased by an amount corresponding to the shunt current I1. For this reason, in the present embodiment, a difference between the deflection force 21R affecting the electron beam 19R and the deflection force 21B affecting the electron beam 19B is decreased both in its horizontal and vertical components.

Figure 7A:
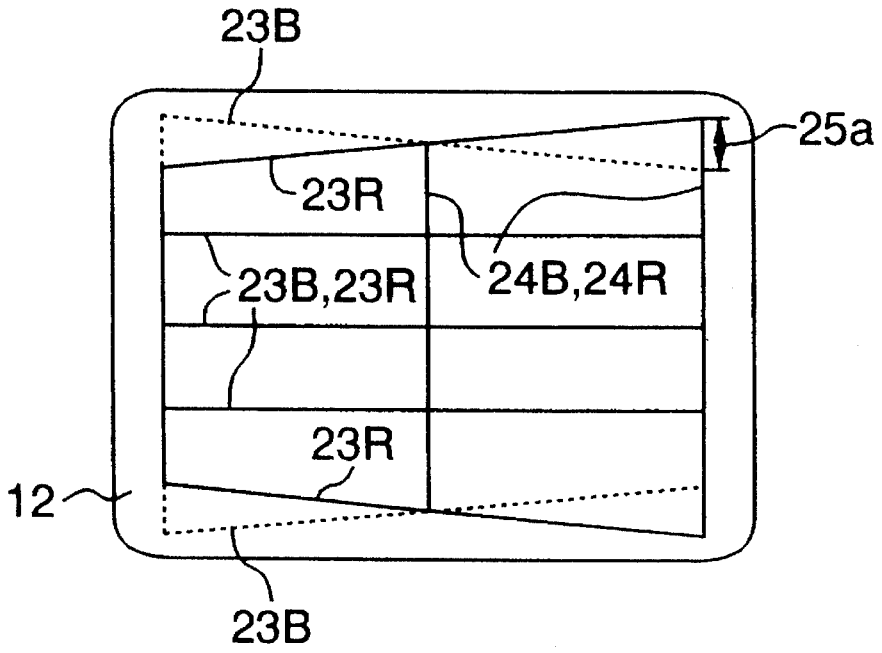
FIG. 7A PRIOR ART
FIGS. 7A and 7B are convergence patterns for explaining the operation of the first embodiment of the deflection yoke in accordance with the present invention.
Figure 7B:
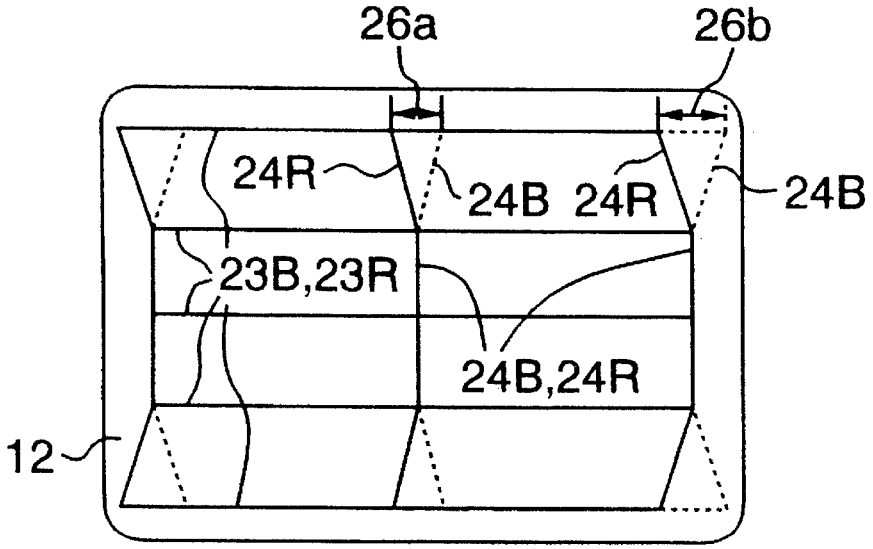

It will be appreciated from the above that the vertical deflection magnetic field 20 generated by such a prior art deflection yoke as shown in FIG. 3A causes a misconvergence 25*a* in horizontal lines at the upper and lower parts of the screen as shown in FIG. 7A; whereas, in such an embodiment as shown in FIG. 3B, in the case of the vertical deflection magnetic field 20 affected only by a decrease in the current flowing the second coil parts 3*c* and 3*d*, the misconvergence 25*a* at the upper and lower parts of the screen can be corrected as shown in FIG. 7B. In the present embodiment, however, vertical line misconvergences 26*a* and 26*b* appear a the upper and lower parts of the screen. Further, since the vertical deflection magnetic field 20 is inflected as shown in FIG. 3B, the vertical line misconvergence 26*b* appearing at the left and right ends of the screen upper part is greater than the vertical line misconvergence 26*a* appearing at the center of the screen upper part.

When an area of the screen other than the non-correction range is subjected to the vertical deflection, a difference between the currents flowing through the upper and lower side core parts 7*a* and 7*b* of the vertical auxiliary deflection coil 7 is substantially equal to the shunt current I1. More in detail, the current flowing through the second coil parts 3*c* and 3*d* are always equally distributed into the upper and lower side core parts 7*a* and 7*b*. However, when the screen upper part is subjected to the vertical deflection, most of the shunt current I1 flowing the second shunt circuit including the diode 18*b* flows through the lower side coil part 7*b*, thereby causing an imbalance between the currents flowing through the upper and lower side core parts 7*a* and 7*b*. Similarly, when the screen lower part is subjected to the vertical deflection, most of the shunt current I1 flowing through the first shunt circuit including the diode 18*a* flows through the upper side core part 7*a*, thereby causing an imbalance between the currents flowing the upper and lower side core parts 7*a* and 7*b*.

Figure 8A:
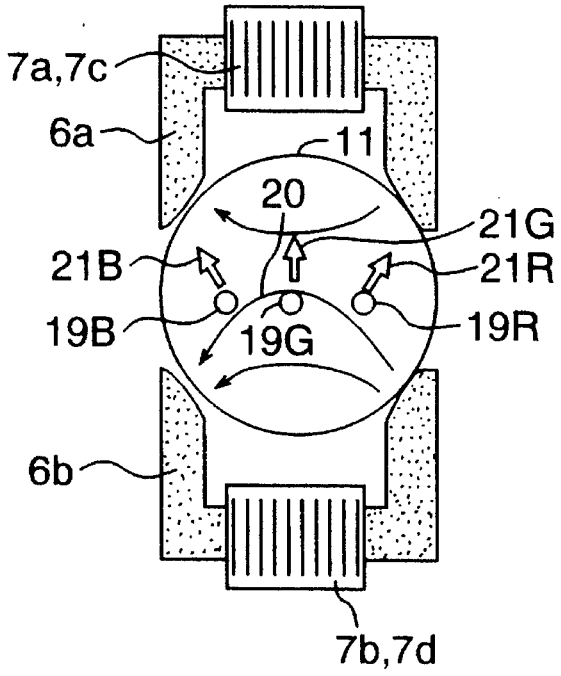
FIGS. 8A and 8B are diagrams for explaining a variation in the vertical deflection magnetic field caused by the vertical auxiliary deflection coil in the first embodiment of the deflection yoke in accordance with the present invention.

When the screen upper part is subjected the vertical deflection, the upper side core part 7*a* produces between both ends of the subcore member 6*a* a magnetic field directed from right to left and made downwardly convex as shown in FIG. 8A. This magnetic field contains 4 polar magnetic field components, i.e., 2 components directed from right to left in the drawing, one component directed downwardly on the side of the side electron beam 21R and one component directed upwardly on the side of the side electron beam 21B.

The lower side coil part 7*b*, on the other hand, produces between both ends of the subcore member 6*b* a magnetic field directed from right to left and made upwardly convex as shown in FIG. 8A. This magnetic field contains 4 polar magnetic field components, i.e., 2 components directed from right to left in the drawing, one component directed upwardly on the side of the side electron beam 21R and one component directed downwardly on the side of the side electron beam 21B.

That is, the 4 polar magnetic field components generated by the upper side core part 7*a* are mutually opposed in direction to those generated by the lower side coil part 7*b*.

Therefore, when the screen upper part is subjected to the deflection, the current flowing through the lower side coil part 7*b* is greater than the current flowing through the upper side core part 7*a*, so that the 4 polar magnetic field components generated by the lower side coil part 7*b* are stronger than those generated by the upper side core part 7*a*, which results in that the 4 polar components of the combined magnetic field have the same directions of the 4 polar magnetic field components generated by the lower side coil part 7*b*. Further, since the 2 polar components of the combined magnetic field are the same in direction as the 2 polar magnetic field components generated by the upper and lower side core parts 7*a* and 7*b*, these components are strengthened.

Figure 8B:
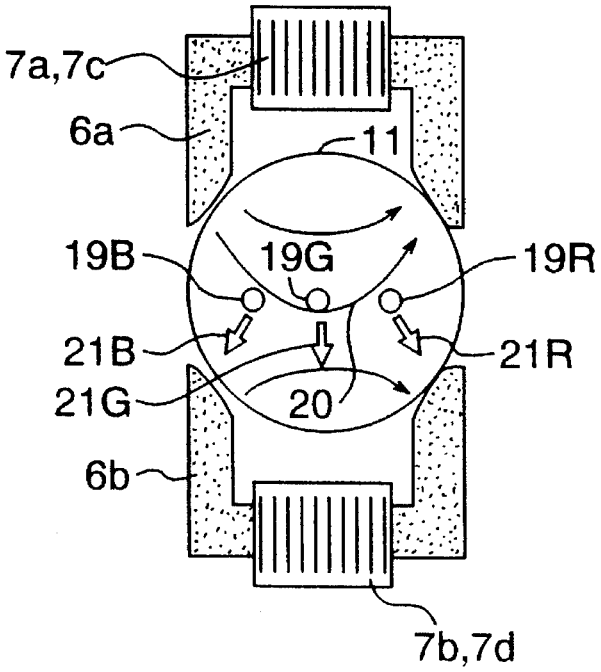

As a result, as shown in FIG. 8B, the magnetic field generated by both of the upper and lower side coil parts 7*a* and 7*b* corresponds to a combination of the above 2 polar magnetic field components and 4 polar magnetic field components, whereby, in the vicinity of the electron beams 19B, 19G and 19R, the vertical deflection magnetic field 20 is made upwardly convex, with the result that the deflection forces 21B and 21R in mutually divergent directions act on the electron beams 19B and 19R respectively.

When the screen lower part is subjected to the deflection, the current flowing through the upper side core part 7*a* is greater than the current flowing through the lower side coil part 7*b* and the directions of the magnetic fields generated by the upper and lower side coil parts 7*a* and 7*b* are opposite to the above case.

Thus, the 2 polar components of the magnetic field generated by both the upper and lower coil parts 7*a* and 7*b* are opposite to the above case; while the 4 polar components of the magnetic field generated by the both upper and lower coil parts 7*a* and 7*b* are the same as in the above case.

As a result, as shown in FIG. 8A, the magnetic field generated by both of the upper and lower side coil parts 7*a* and 7*b* corresponds to a combination of the above 2 polar magnetic field components and 4 polar magnetic field components, whereby, in the vicinity of the electron beams 19B, 19G and 19R, the vertical deflection magnetic field 20 is made downwardly convex, with the result that the deflection forces 21B and 21R in mutually divergent directions act on the electron beams 19B and 19R respectively.

Thus, as shown in FIG. 7B, the vertical line 24R by the electron beam 19R on the screen upper part can be position-corrected rightwardly and the vertical line 24B by the electron beam 19B can be position-corrected leftwardly, whereby the vertical lines 24R and 24B can be coincided and the vertical line misconvergences 26*a* and 26*b* can be corrected.

As mentioned above, when the directions of the 4 polar magnetic field components generated by the first correction coil part (upper side core part 7*a*) of the vertical auxiliary deflection coil 7 are opposite to those generated by the second correction coil part (lower side coil part 7*b*), the vertical line misconvergence 26*b* can be corrected. For this reason, the first and second coil parts of the vertical auxiliary deflection coil 7 are not limited to the specific ones given in the present embodiment. For example, any type of coils may be employed so long as they have a function of merely generating the 4 polar magnetic field. Further, the upper and lower side coil parts 7*a* and 7*b* in the present embodiment, which each generate the 2 polar magnetic field components, may be arranged to have an auxiliary vertical deflection action to change the landing conditions of the electron beams on the phosphor screen 12 to desired conditions.

Figure 9:
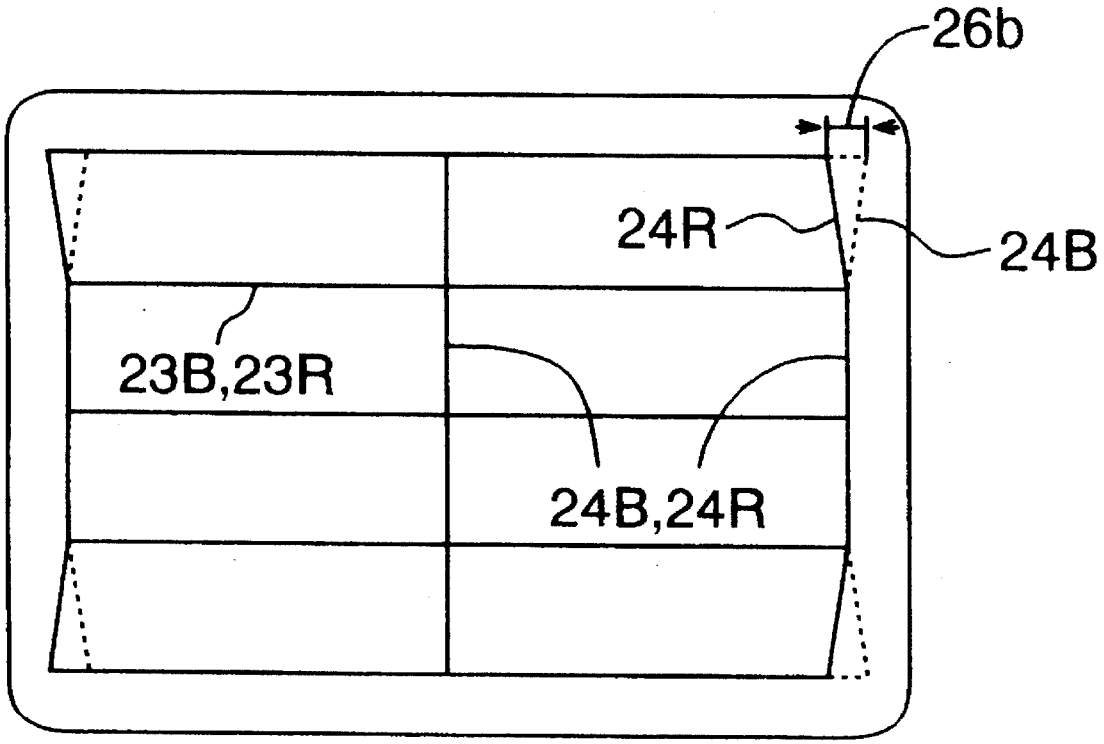
FIG. 9 is a convergence pattern for explaining the operation of the first embodiment of the deflection yoke in accordance with the present invention.

Since the vertical line misconvergence 26*b* at the left and right ends of the screen upper and lower parts is larger than the vertical line misconvergence 26*a* at the center of the screen upper and lower parts as mentioned above, even when the vertical line misconvergence 26*a* is corrected, the correction of the vertical line misconvergence 26*b* is insufficient and the vertical line misconvergence 26*b* still remains as shown in FIG. 9. The remaining vertical line misconvergence 26*b* can be relatively simply corrected by suitably setting the winding density distribution of the horizontal and vertical deflection coils 2 and 3.

In the present embodiment, as mentioned above, the horizontal line misconvergence 25*a* at the upper and lower parts of the screen can be corrected the vertical line misconvergences 26*a* and 26*b* caused by this correction can be efficiently corrected.

When the resistive value of a series circuit of the thermistor 16*a* and fixed resistor 14*d* is arranged to have a negative temperature coefficient, fluctuations in the operational characteristics of the diodes 18*a* and 18*b* caused by the temperature change can be compensated for, whereby there can be realized a deflection yoke which has excellent convergence characteristics with less temperature drift.

Figure 10:
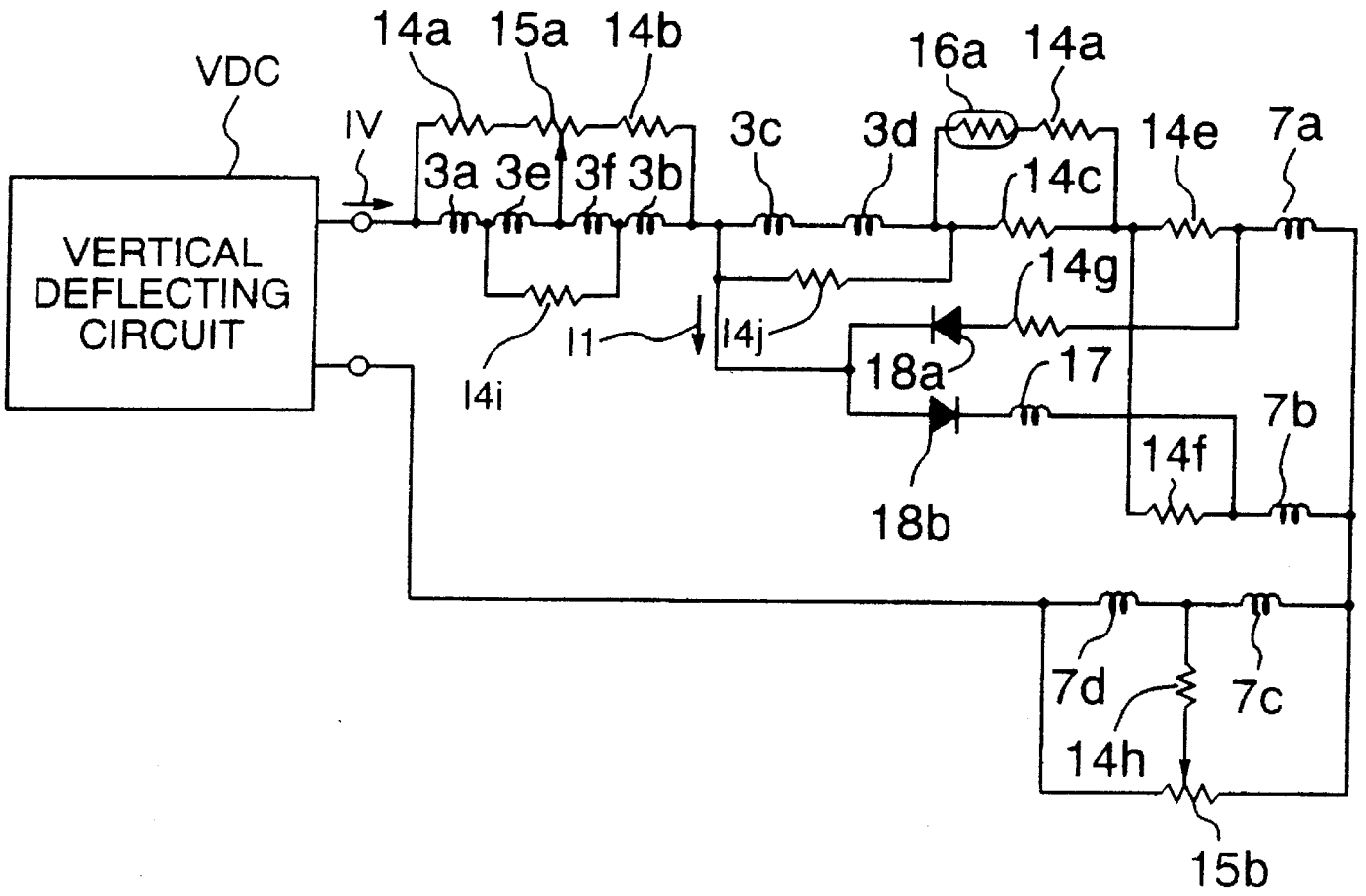
FIG. 10 is a circuit diagram of a deflection yoke in accordance with a second embodiment of the present invention.

FIG. 10 is a circuit diagram of a vertical deflection system in a deflection yoke in accordance with a second embodiment of the present invention, wherein reference symbols 3*e* and 3*f* denote third coil parts, 14*i* and 14*j* denote fixed resistors, parts corresponding to those in FIG. 4 are denoted by the same reference numerals or symbols and explanation thereof is omitted.

In FIG. 10, in place of the first coil part 3*a* in the embodiment of FIG. 4, a series circuit of the first and third coil parts 3*a* and 3*e* is employed; while, in place of the first coil part 3*b* in the embodiment of FIG. 4, a series circuit of the third and first coil parts 3*f* and 3*b* is employed.

Figure 11A:
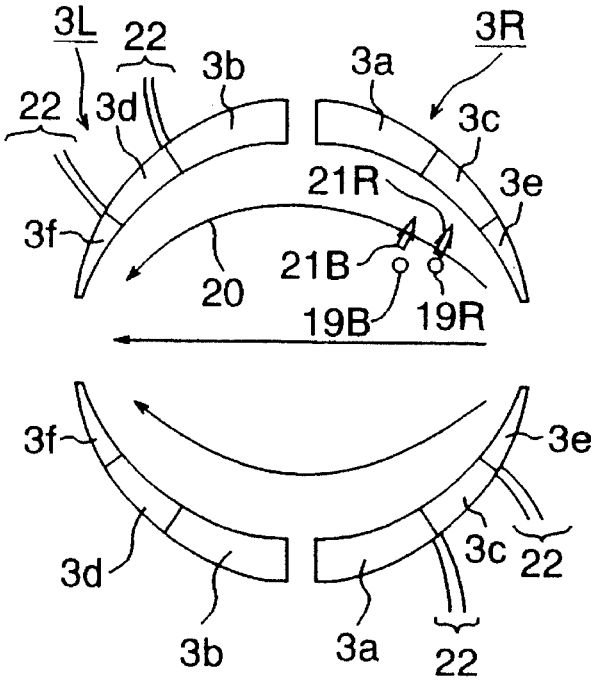
FIGS. 11A and 11B are cross-sectional views of a structure of a vertical deflection coil in the deflection yoke in the second embodiment of the present invention and of a structure of a corresponding coil in the prior art for comparison of vertical deflection magnetic field.
Figure 11B:
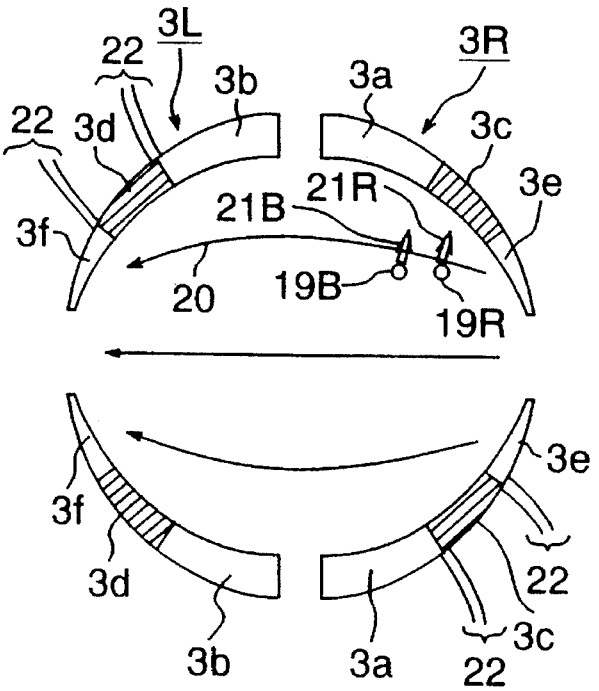

Shown in FIGS. 11A and 11B are cross-sectional views of the vertical deflection coil 3 in the present embodiment as viewed from the side of the phosphor screen 12, in which the right-side coil half 3R is divided by the centertap 22 into the first, second and third coil parts 3*a*, 3*c* and 3*e* in the order from its outside; while the left-side coil half 3L is similarly divided into the first, second and third coil parts 3*b*, 3*d* and 3*f*. And these coil parts are wired in such a manner as shown in FIG. 10. The interconnection of the second coil parts 3*c* and 3*d* is the same as that shown in FIG. 4.

Further, the third coil parts 3*e* and 3*f* connected in series is connected in parallel to a fixed resistor 14*i*, and the second coil parts 3*c* and 3*d* connected in series is connected in parallel to a fixed resistor 14*j*. These fixed resistors 14*i* and 14*j* are provided as necessary for the purpose of eliminating the damping of a ringing current caused by the coil resonance and the switching noises of the diodes 18*a* and 18*b*.

Other arrangement other than the above is substantially the same as that in the embodiment of FIG. 4.

The present embodiment is featured in that, by changing the position of the centertap 22, the winding position of the second coil part 3*c* of the right-side coil half 3R and the winding position of the second coil part 3*d* of the left-side coil half 3L can be arbitrarily set in a range of the coil halves 3R and 3L. As a result, in the prior art deflection yoke, the vertical deflection magnetic field 20 is of a stronger barrel shape as shown in FIG. 11A; whereas, in the present embodiment, the action of the shunt current I1 flowing only in the vertical deflection mode at the screen upper and lower parts causes decrease of a current flowing through the second coil parts 3*c* and 3*d* shown by hatched areas, resulting in that the vertical deflection magnetic field 20 of a weaker barrel shape, as shown in FIG. 11B.

Figure 12:
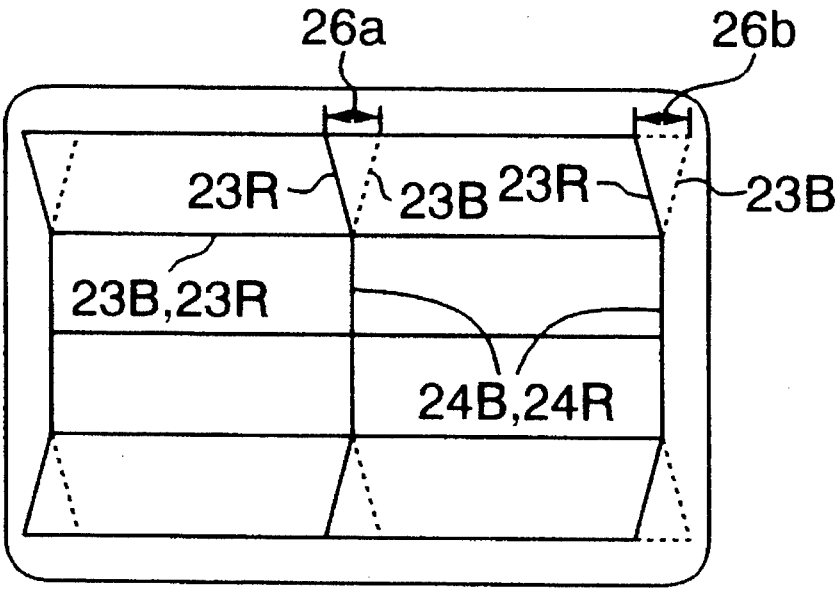
FIG. 12 is a convergence pattern for explaining the operation of the second embodiment of the deflection yoke in accordance with the present invention.

For this reason, in the case where the present embodiment is not applied and the horizontal line misconvergence 25*a* appears only on horizontal lines at the screen upper and lower parts as shown in FIG. 7A, application of the present embodiment to this case causes a current flowing through the second coil parts 3*c* and 3*d* to be decreased, so that the horizontal line misconvergence 25*a* on horizontal lines at the screen upper and lower parts can be corrected as shown in FIG. 12.

Figure 13:
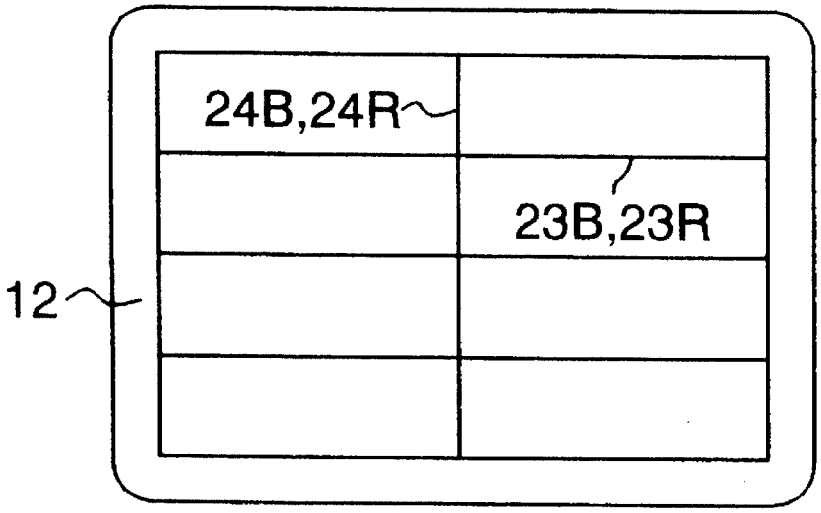
FIG. 13 is a convergence pattern for explaining the operation of the second embodiment of the deflection yoke in accordance with the present invention.

Even in this case, the vertical line misconvergences 26*a* and 26*b* appear at the screen upper and lower parts, but when the positions of the second coil parts 3*c* and 3*d* are adjusted through the centertap 22, the inflection of the vertical deflection magnetic field 20 shown in FIG. 11B can be made to be less than that of the vertical deflection magnetic field 20 shown in FIG. 3B in the embodiment of FIG. 4, with the result that the vertical line misconvergence 26*b* at the left and right ends of the screen upper and lower parts can be made substantially equal to the vertical line misconvergence 26*a* at the center of the screen upper and lower parts. Accordingly, in combination with the aforementioned action that the shunt current I1 causes imbalance between the currents flowing through the upper and lower side coil parts 7*a* and 7*b* of the vertical auxiliary deflection coil 7, the vertical line misconvergence 26*b* at the left and right ends of the screen upper and lower parts as well as the vertical line misconvergence 26*a* at the center of the screen upper and lower parts can be simultaneously corrected, whereby a good image can be obtained with improved horizontal and vertical line convergence performances as shown in FIG. 13.

Figure 14:
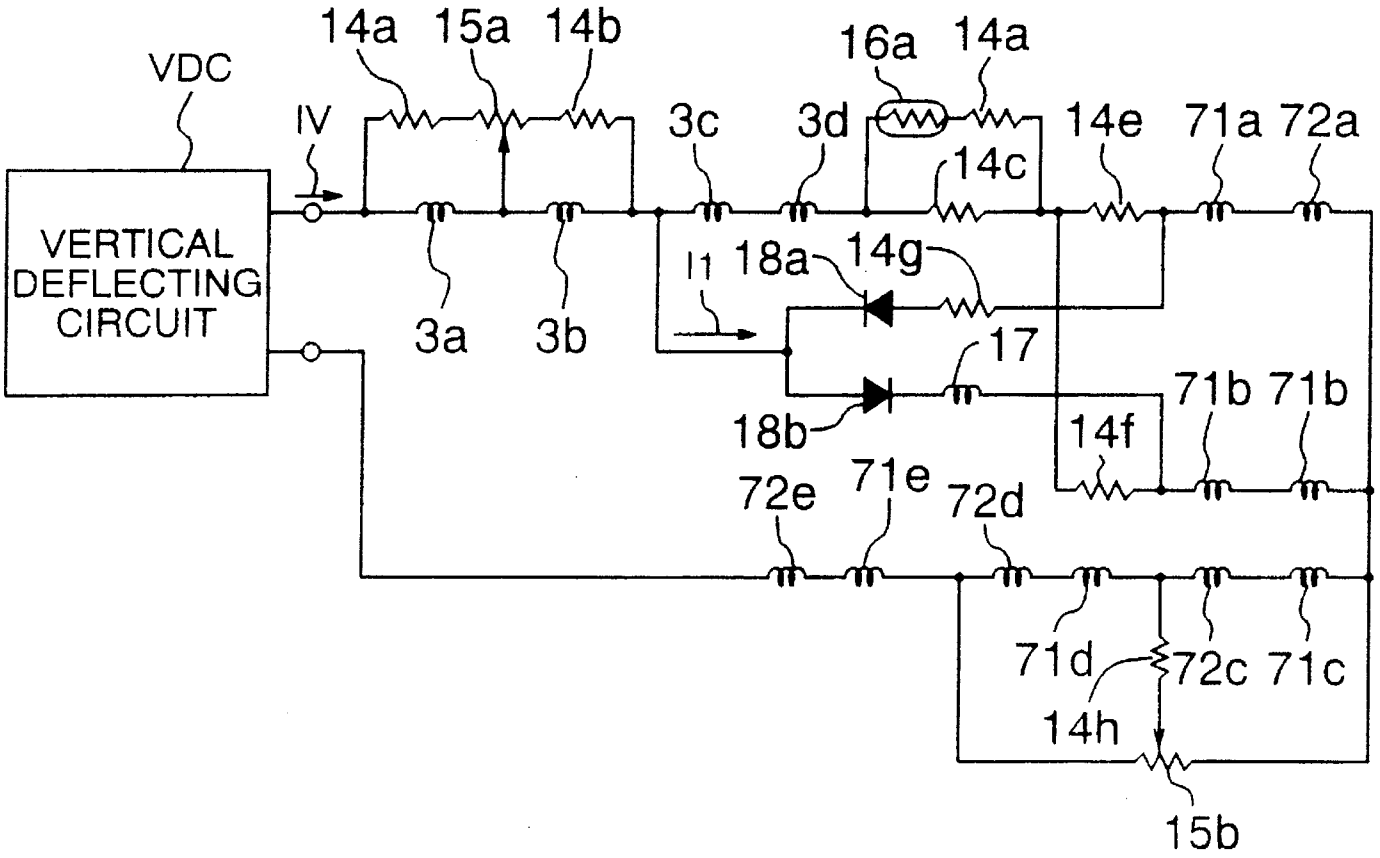
FIG. 14 is a circuit diagram of a deflection yoke in accordance with a third embodiment of the present invention.

FIG. 14 is a circuit diagram of a vertical deflection system in a deflection yoke in accordance with a third embodiment of the present invention, which includes first upper side coil parts 71*a* and 72*a*, first lower side coil parts 71*b* and 72*b*, second upper side coil parts 71*c* and 72*c*, second lower coil parts 71*d* and 72*d*, center coil parts 71*e* and 72*e*, parts corresponding to those in FIG. 4 being denoted by the same reference numerals or symbols and explanation thereof being omitted.

In FIG. 14, the upper side core part 7*a* in the embodiment of FIG. 4 is replaced by a series circuit of the first upper side coil parts 71*a* and 72*a;* the upper side coil part 7*c* in the embodiment of FIG. 4 is replaced by a series circuit of the second upper side coil parts 71*c* and 72*c;* the lower side coil part 7*b* in the embodiment of FIG. 4 is replaced by a series circuit of the first lower side coil parts 71*b* and 72*b;* the lower side coil part 7*d* in the embodiment of FIG. 4 is replaced by a series circuit of the second lower coil parts 71*d* and 72*d;* and the center coil parts 71*e* and 72*e* are connected in series between a junction point of the second lower coil part 72*d* and variable resistor 15*b* and the vertical deflection circuit VDC. Other arrangement is substantially the same as that of the embodiment of FIG. 4.

Figure 15:
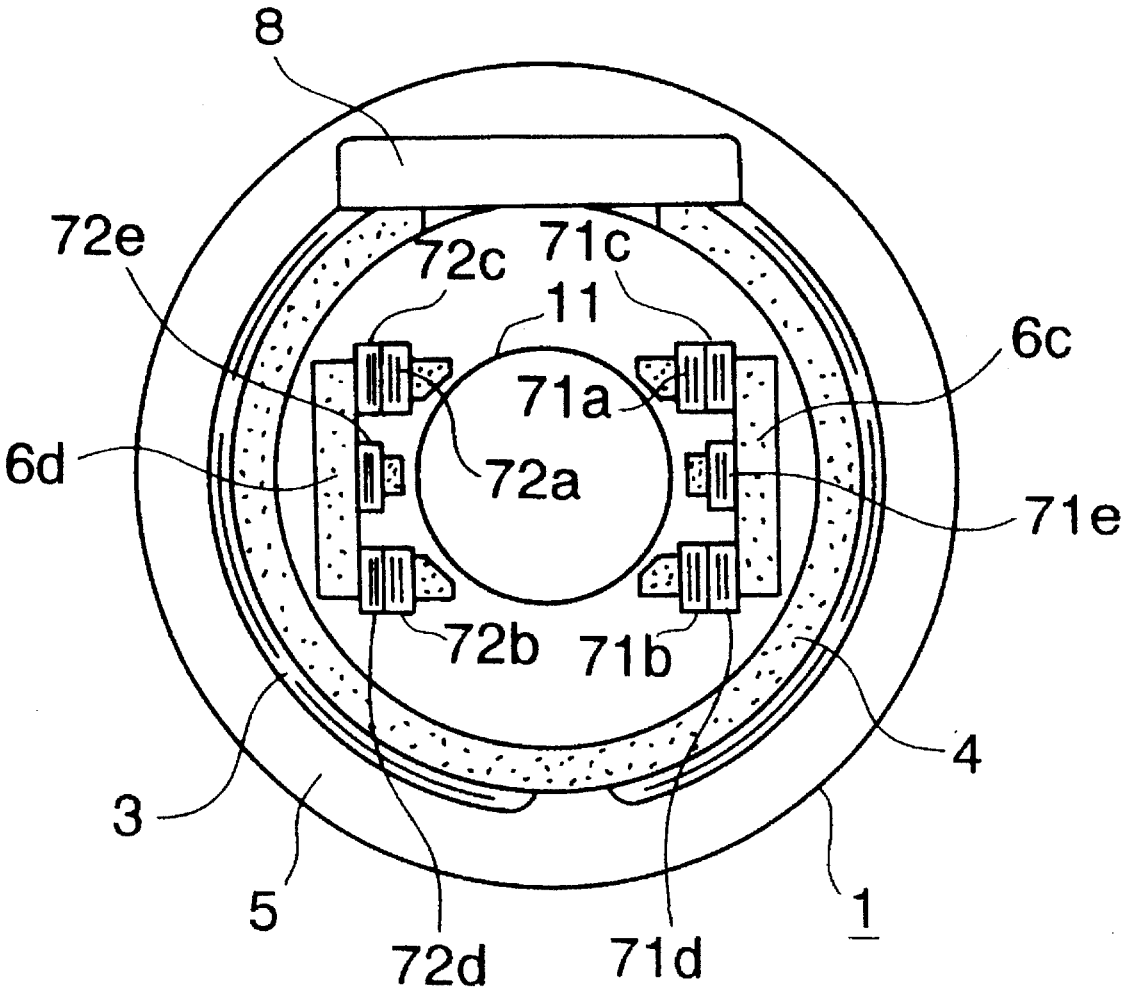
FIG. 15 is a rear view of a vertical auxiliary deflection coil in the third embodiment of the deflection yoke in accordance with the present invention.

Turning now to FIG. 15, there is shown a rear view of the vertical auxiliary deflection coil 7 in the present embodiment, wherein reference symbols 6*c* and 6*d* denote subcores and parts corresponding to those in FIGS. 14 and 2 are denoted by the same reference numerals or symbols.

In FIG. 15, the subcores 6*c* and 6*d* each having 3 legs are disposed as opposed to each other on both left and right sides of the color cathode-ray tube 11. More specifically, the subcore 6*c* has the upper leg around which the first and second upper side coil parts 71*a* and 71*c* are wound, has the lower leg around which the first and second lower side coil parts 71*b* and 71*d* are wound, and has the center leg around which the center coil part 71*e* is wound. Similarly, the subcore 6*d* has the upper leg around which the first and second upper side coil parts 72*a* and 72*c* are wound, has the lower leg around which the first and second lower side coil parts 72*b* and 72*d* are wound, and has the center leg around which the center coil part 72*e* is wound. These coil parts are wired in such a manner as shown in FIG. 14.

Figure 16A:
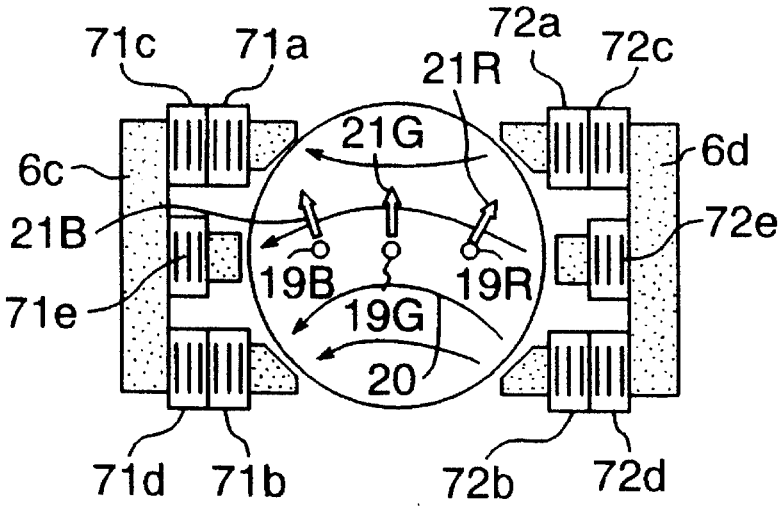
FIGS. 16A and 16B show how the vertical deflection magnetic field is affected by the vertical auxiliary deflection coil shown in FIG. 15.
Figure 16B:
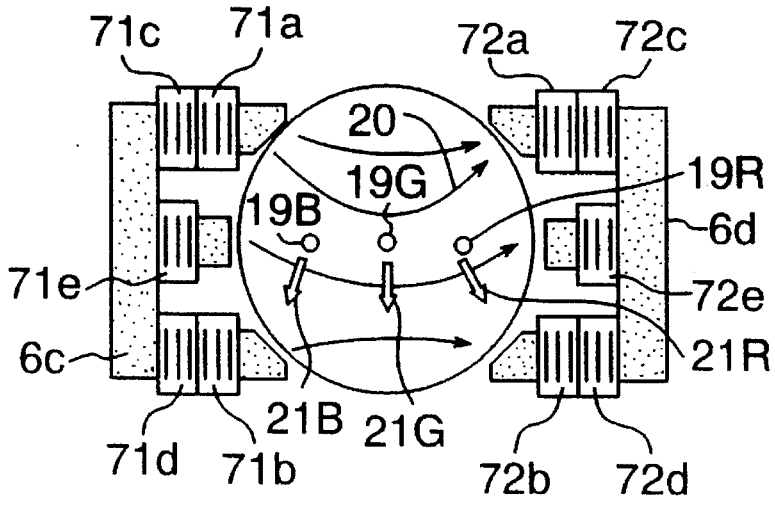

With such an arrangement as mentioned above, as in the embodiment of FIG. 4, when the screen upper part is subjected to a vertical deflection by the action of the shunt current I1, the vertical deflection magnetic field 20 is made to have an upwardly convex shape and to act the deflection forces 21B and 21R on the electron beams 19B and 19R in mutually divergent directions respectively as shown in FIG. 16A; whereas, when the screen lower part is subjected to the vertical deflection, the vertical deflection magnetic field 20 is made to have an downwardly convex shape and to act the deflection forces 21B and 21R on the electron beams 19B and 19R in mutually divergent directions respectively as shown in FIG. 16B. As a result, such a horizontal line misconvergence 25*a* at the screen upper and lower parts as shown in FIG. 7A can be corrected and such a vertical line misconvergence 26*a* caused by the above correction as shown in FIG. 7B can also be corrected. Further, the provision of the center coil parts 71*e* and 72*e* enables generation of a 2 polar magnetic field and change of the landing conditions of the electron beams on the phosphor screen 12, thus increasing the design flexibility.

Figure 17:
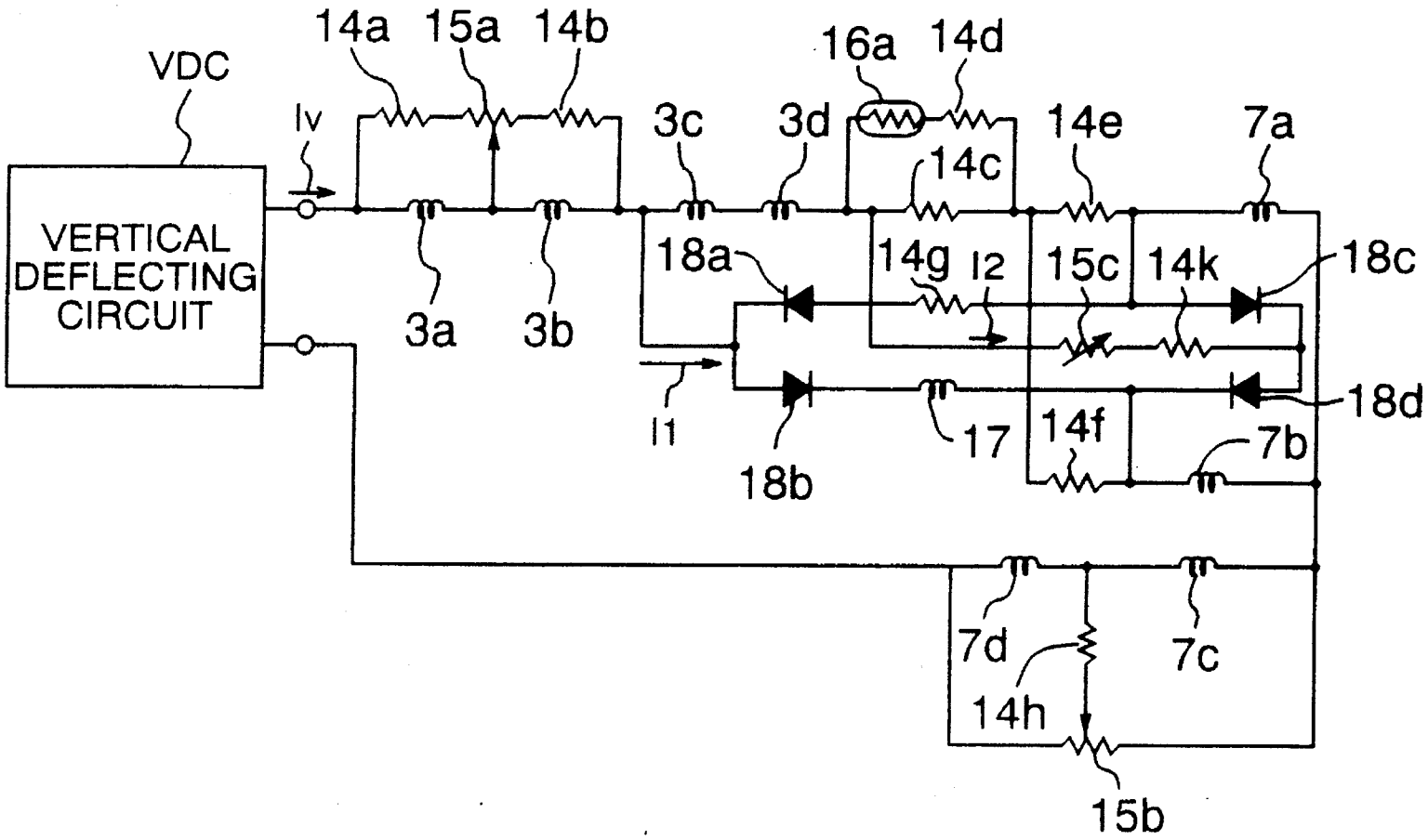
FIG. 17 is a circuit diagram of a deflection yoke in accordance with a fourth embodiment of the present invention.

Turning now to FIG. 17, there is shown a circuit diagram of a vertical deflection system in a deflection yoke in accordance with a fourth embodiment of the present invention, which includes a fixed resistor 14*k*, a variable resistor 15*c*, diodes 18*c* and 18*d*, and wherein parts corresponding to those in FIG. 4 are denoted by the same reference numerals or symbols and explanation thereof is omitted.

As shown in FIG. 17, in the present embodiment, a series circuit of the diodes 18*c* and 18*d* is connected in parallel to a series circuit of the fixed resistor 14*g*, diodes 18*a* and 18*b* and inductor 17, while the fixed resistor 14*k* and variable resistor 15*c* are connected in series between a junction point of the diodes 18*c* and 18*d* and a junction point of the second coil part 3*d* of the vertical deflection coil 3 and fixed resistor 14*c*.

In the series circuit of the diodes 18*c* and 18*d*, the diode 18*c* is connected at its anode to a junction point of the fixed resistor 14*e* an the upper side core part 7*a* of the vertical auxiliary deflection coil 7; while the diode 18*d* is connected at its cathode to a junction point of the fixed resistor 14*f* and the lower side coil part 7*b* of the vertical auxiliary deflection coil 7 respectively.

In other words, a series circuit of the variable resistor 15*c*, fixed resistor 14*k* and diode 18*c* connected reversely with respect to the a shunt current I2 shown by an arrow is connected in parallel to a circuit including the fixed resistors 14*d*, 14*c*, 14*e* and thermistor 16*a;* while a series circuit of the variable resistor 15*c*, fixed resistor 14*k* and diode 18*d* connected forwardly with respect thereto is connected in parallel to a circuit including the fixed resistors 14*d*, 14*c*, 14*f* and thermistor 16*a*.

Figure 18A:
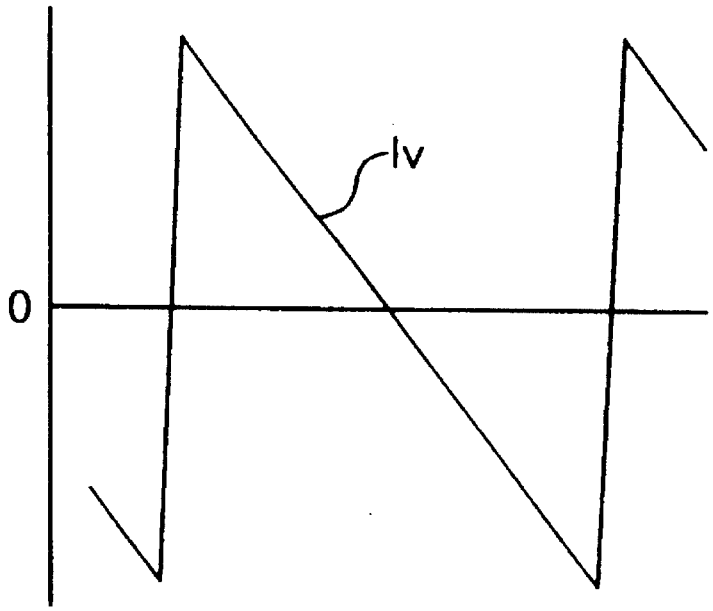
FIGS. 18A and 18B show diagrams of waveforms of a vertical deflection current and its shunt current in FIG. 17.
Figure 18B:
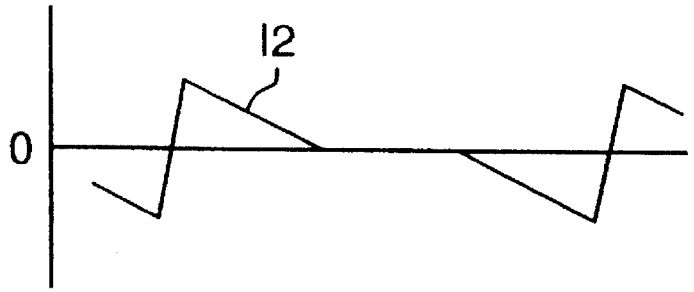

With such an arrangement as mentioned above, the action of the diodes 18*c* and 18*d* causes the shunt current I2 flowing through the fixed resistor 14*d* and variable resistor 15*c* to have such a waveform as shown in FIG. 18, (*b*) with respect to the vertical deflection current Iv shown in FIG. 18, (*a*). And when the forward voltage of the diodes 18*c* and 18*d* is suitably selected, no current I2 flows during the vertical deflection within a non-correction range 27 in FIG. 19, the diode 18*d* is conducted to pass the current I2 in its positive direction therethrough during the vertical deflection at the screen upper part in a range other than the non-correction range 27, and the diode 18*c* is conducted to pass the current I2 in its negative direction therethrough during the vertical deflection at the screen lower part in a range other than the non-correction range 27, whereby the vertical line misconvergences 26*a* and 26*b* at the screen upper and lower parts can be corrected.

Further, when the variable resistor 15*c* is adjusted to change the amplitude of the current I2, corrections in the vertical line misconvergences 26*a* and 26*b* at the screen upper and lower parts can be adjusted.

Figure 19:
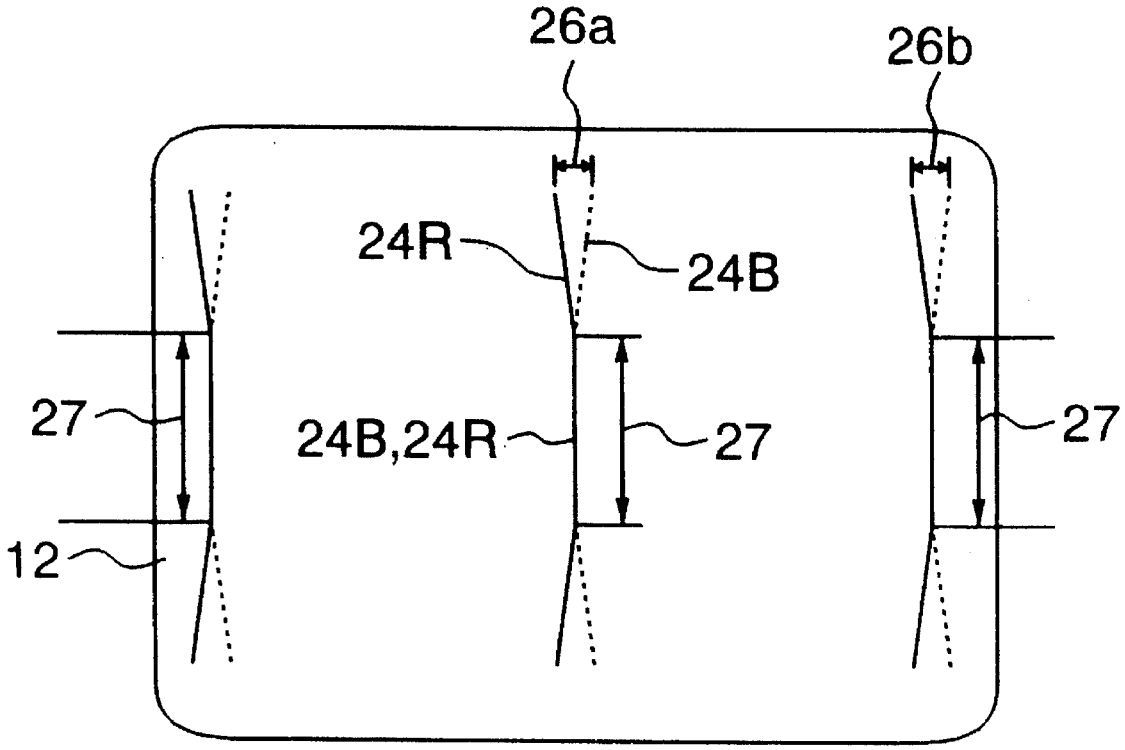
FIG. 19 is a convergence pattern for explaining the operation of the fourth embodiment of the deflection yoke in accordance with the present invention.

Accordingly, when the present embodiment is applied under such a condition that the vertical line misconvergences 26*a* and 26*b* at the screen upper and lower parts in the case of no provision of the diodes 18*c* and 18*d* are slightly generated in such a direction as shown in FIG. 19, the misconvergences can be corrected by adjusting the variable resistor 15*c* even when the vertical line misconvergences 26*a* and 26*b* are changed due to the manufacturing error.

When the polarities of the diodes 18*c* and 18*d* are opposed to those illustrated in FIG. 17, the vertical line misconvergences 26*a* and 26*b* in the opposite direction to in the case of FIG. 19 can be corrected.

Further, a plurality of shunt circuits similar to the shunt circuit of the diodes 18*c* and 18*d* and having mutually different forward voltages may be connected in parallel stages to correct the vertical misconvergences with use of a more broken line approximation approach. More in detail, when the shunt current I2 is approximated as a plurality of broken lines to change the shunt current smoothly, preciser correction of the vertical misconvergences can be realized.

Figure 20:
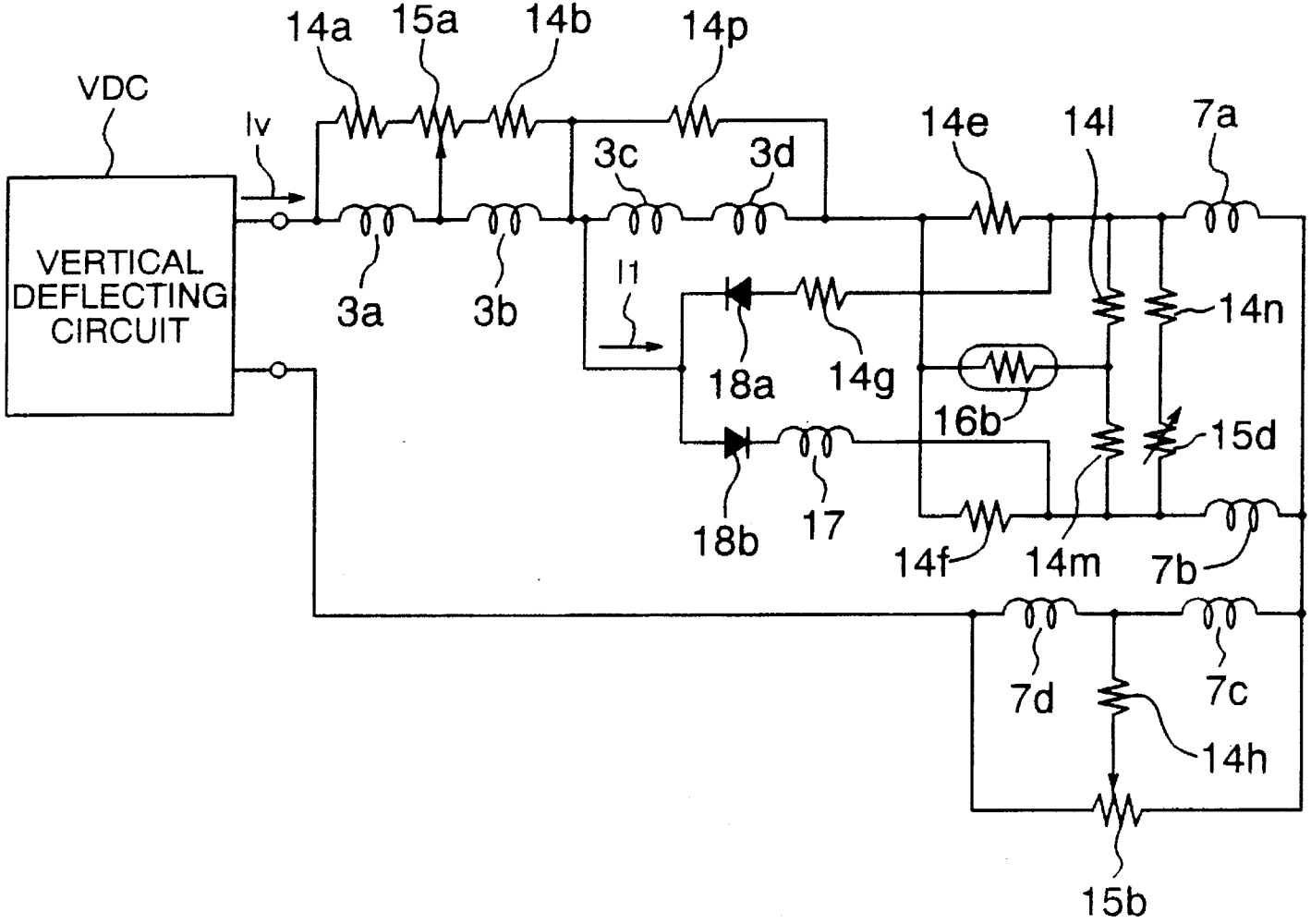
FIG. 20 is a circuit diagram of a deflection yoke in accordance with a fifth embodiment of the present invention.

FIG. 20 is a circuit diagram of a vertical deflection system in a deflection yoke in accordance with a fifth embodiment of the present invention, which includes fixed resistors 14*l* to 14*n*, 14*p*, a variable resistor 15*d*, a thermistor 16*b*, and in which parts corresponding to those in FIG. 4 are denoted by the same reference numerals or symbols and explanation thereof is omitted.

The embodiment of FIG. 20 is different from the embodiment of FIG. 4 in that the impedance circuit of the thermistor 16*a* and fixed resistors 14*c* and 14*d* is removed from the arrangement of FIG. 4, in that the fixed resistor 14*p* is connected in parallel to the second coil parts 3*c* and 3*d* of the vertical deflection coil 3, in that a series circuit of the fixed resistors 14*l* and 14*m* and a series circuit of the fixed resistor 14*n* and variable resistor 15*d* are connected in parallel between a junction point of the fixed resistor 14*e* and the upper side core part 7*a* of the vertical auxiliary deflection coil 7 and a junction point of the fixed resistor 14*f* and the lower side coil part 7*b* of the vertical auxiliary deflection coil 7, and in that the thermistor 16*b* for temperature compensation is connected between a junction point of the fixed resistors 14*e* and 14*f* and a junction point of the fixed resistors 14*l* and 14*m*.

In such an arrangement, the fixed resistors 14*e* and 14*f* are set to have large resistive values. Connected to a junction point of the fixed resistors 14*e* and 14*f* is a T-shaped circuit of the thermistor 16*b* and fixed resistors 14*l* and 14*m*. Similarly to the fixed resistor 14*j* in the embodiment of FIG. 10, the fixed resistor 14*p* functions to eliminate the switching noises of the diodes 18*a* and 18*b*.

In the present embodiment, when the resistive value of the variable resistor 15*d* is adjusted, a difference between currents flowing through the upper and lower side coil parts 7*a* and 7*b* of the vertical auxiliary deflection coil 7 can be changed while keeping substantially constant the amplitude of the shunt current I1 flowing through the diodes 18*a* and 18*b*. More specifically, when the resistive value of the variable resistor 15*d* is made extremely large, most of the shunt current I1 flowing the diode 18*b* flows through the lower side coil part 7*b* while most of the shunt current I1 flowing through the diode 18*a* flows through the upper side core part 7*a*. When resistive value of the variable resistor 15*d* is set at zero, the shunt current I1 flowing through the diodes 18*a* and 18*b* flows equally into the upper and lower side coil parts 7*a* and 7*b*. In this way, the difference (imbalance) between the currents flowing through the upper and lower side coil parts 7*a* and 7*b* can be set differently according to the resistive value of the variable resistor 15*d*. The position of the vertical line 24R in the horizontal (left and right) direction in FIG. 7B is different from the position of the vertical line 24B in the horizontal direction depending on the difference between the currents flowing through the coil parts 7*a* and 7*b*. Thus, when the resistive value of the variable resistor 15*d* is controlled, such a vertical line misconvergence 26*a* at the center of the screen upper and lower parts as shown in FIG. 7B can be adjusted.

An adjustment in the vertical line misconvergence 26*a* at the center of the screen upper and lower parts is increased by increasing the resistive values of the fixed resistors 14*e* and 14*f* as mentioned above. Accordingly, as in the embodiment of FIG. 17, the vertical line misconvergence 26*a* at the center of the screen upper and lower parts can be adjusted without provision of the dedicated diodes 18*c* and 18*d*.

Even when the configuration of FIG. 20 is modified into the following configuration, desired misconvergence adjustment can be realized through the operation of the variable resistor. That is, the second coil parts 3*c* and 3*d* and fixed resistor 14*p* are eliminated, a first impedance circuit (14*e*, 14*l*, 16*b*) is provided between the first coil part 3*b* and upper side core part (first correction coil) 7*a* (first correction coil), a second impedance circuit (14*f*, 14*m*, 16*b*) is provided between the first coil part 3*b* and lower side coil part 7*b* (second correction coil), a series circuit of the first impedance circuit and first correction coil 7*a* is connected in parallel to a series circuit of the second impedance circuit and second correction coil 7*b* to form a parallel circuit, the parallel circuit is connected in series with the vertical deflection coil, a first shunt circuit (18*a*, 14*g*) is provided for shunting part of the vertical deflection current flowing through the first impedance circuit when the vertical deflection current has a constant value or more and flows in a first direction, a second shunt circuit (18*b*, 17) is provided for shunting part of the vertical deflection current flowing through the second impedance circuit in the opposite direction when the vertical deflection current has a constant value or more and flows in the direction opposite to the first direction, a shunt control circuit is provided having a function of causing a predetermined imbalance between the currents flowing through the first and second correction coils according to the vertical deflection current, and the variable resistor 15*d* is connected between a junction point of the first impedance circuit and first correction coil and a junction point of second impedance circuit and second correction coil.

Figure 21:
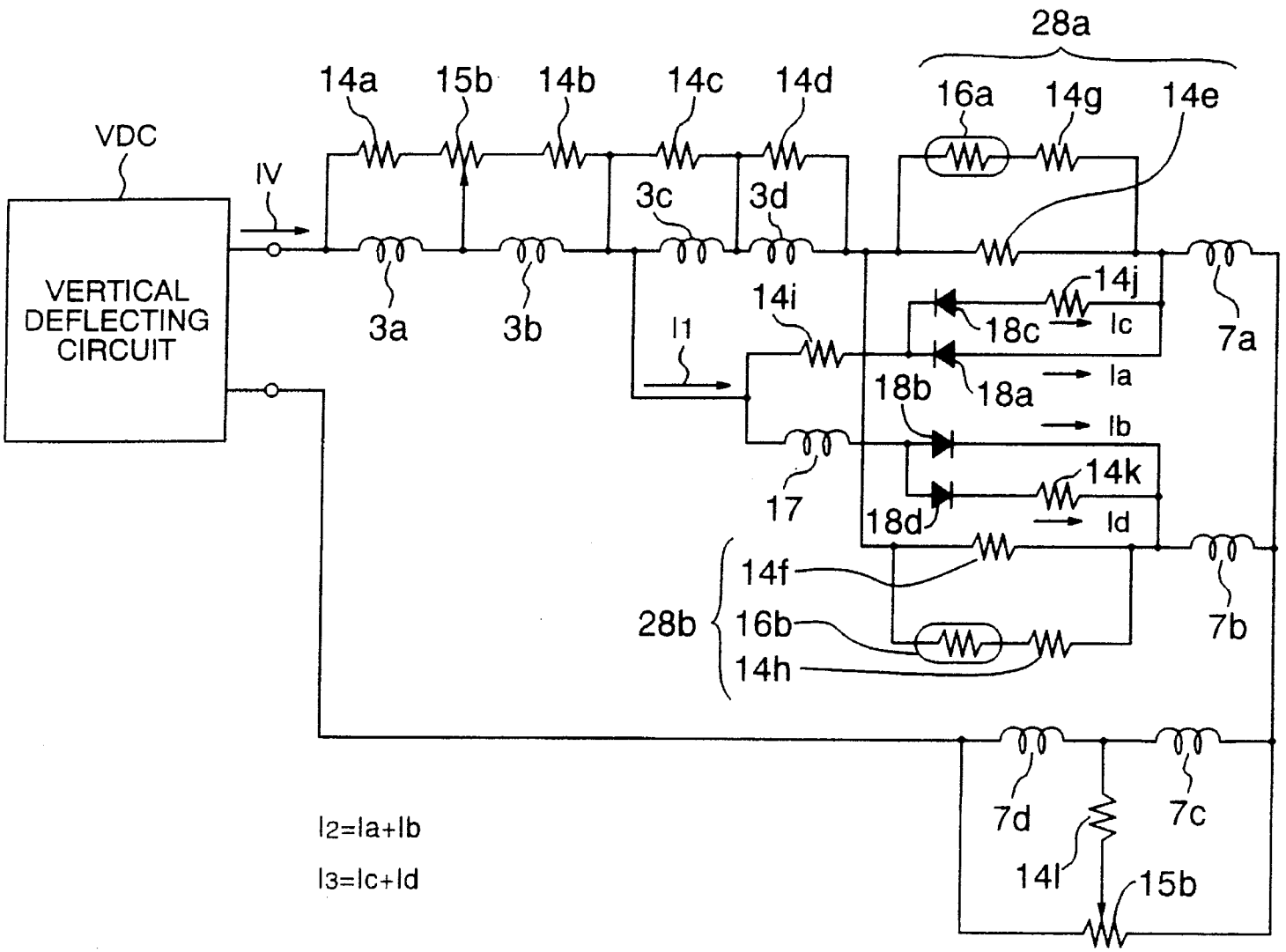
FIG. 21 is a circuit diagram of a deflection yoke in accordance with a sixth embodiment of the present invention.

Shown in FIG. 21 is a circuit diagram of a vertical deflection system in a deflection yoke in accordance with a sixth embodiment of the present invention, in which parts corresponding to those in FIG. 4 are denoted by the same reference numerals or symbols and explanation thereof is omitted.

Major differences between the embodiments of FIGS. 21 and 4 are that the fixed resistors 14*c* and 14*d* are connected in parallel to the second coil parts 3*c* and 3*d*, a series circuit of the thermistor 16*a* and fixed resistor 14*g* is connected in parallel to the fixed resistor 14*e* to form a first impedance circuit 28*a*, a series circuit of the thermistor 16*b* and fixed resistor 14*h* is connected in parallel to the fixed resistor 14*f* to form a second impedance circuit 28*b*, a series circuit of the diode 18*c* and fixed resistor 14*j* is connected in parallel to the diode 18*a*, and a series circuit of the diode 18*d* and fixed resistor 14*k* is connected in parallel to the diode 18*b*. In this connection, the forward voltages of the diodes 18*c* and 18*d* are set to be smaller than the forward voltages of the diodes 18*a* and 18*b*.

There may be considered such a configuration that the directions of the diodes 18*c* and 18*d* are made opposite to the illustrated directions.

These fixed resistors 14*c* and 14*d* function as damping resistors having a function of attenuating resonance currents induced in the second coil parts 3*c* and 3*d*, and may or may not be provided according to the condition of the ringing caused by the resonance currents.

Explanation will then be made as to how the circuit of FIG. 21 is wired in more detail. A series circuit of the fixed resistor 14*i* and diode 18*a* is connected in parallel to the second coil parts 3*c*, 3*d* and first impedance circuit 28*a* to form a first shunt circuit, the diode 18*a* being connected at its cathode to one side of a series circuit of the first and second coil parts 3*b* and 3*c*.

Further, a series circuit of the inductor 17 and diode 18*b* is connected in parallel to the second coil parts 3*c*, 3*d* and second impedance circuit 28*b* to form a second shunt circuit, the diode 18*b* being connected at its anode to one side of a series circuit of the first and second coil parts 3*b* and 3*c*.

Furthermore, a series circuit of the diode 18*c* and fixed resistor 14*j* is connected in parallel to the diode 18*a* to form a third shunt circuit, the diode 18*c* being connected at its cathode to one side of a series circuit of the first and second coil parts 3*b* and 3*c*.

In addition, a series circuit of the diode 18*d* and fixed resistor 14*k* is connected in parallel to the diode 18*b* to form a fourth shunt circuit, the diode 18*d* being connected at its anode to one side of a series circuit of the first and second coil parts 3*b* and 3*c*.

As mentioned above, the forward voltages of the diodes 18*c* and 18*d* are arranged to be smaller than the forward voltages of the diodes 18*a* and 18*b* respectively so that the diodes 18*c* and 18*d* can be put in their current conduction state when subjected to application of smaller voltages.

Shunt currents flow through the first and third shunt circuits in directions opposite to the illustrated directions shown by arrows when the screen lower part is subjected to the vertical deflection based on the polarities of the diodes 18*a* and 18*c*; whereas shunt currents flow through the second and fourth shunt circuits in the illustrated directions shown by arrows when the screen upper part is subjected to the vertical deflection based on the polarities of the diodes 18*b* and 18*d*.

Such a vertical deflection current Iv issued from the vertical deflection circuit VDC as shown in FIG. 23, (*a*) flows through the first coil parts 3*a* and 3*b* and partly flows into a shunt circuit including the diodes 18*a*, 18*c* or 18*b*, 18*d* as the shunt current I1, and the remaining current flows into the second coil parts 3*c* and 3*d*. The shunt current I1 corresponds to a combination of a current I3 flowing through the diodes 18*c* and 18*d* since the vertical deflection current is small as shown in FIG. 23, (*d*) and the shunt current I2 flowing through the diodes 18*a* and 18*b* since the vertical deflection current becomes somewhat larger as shown in FIG. 23, (*c*); and the shunt current I1 has such a waveform as shown in FIG. 23, (*b*).

The currents flowing through the diodes have such waveforms as shown in FIG. 23, (*b*), (*c*) and (*d*). This is because, as mentioned above, the forward voltages of the diodes 18*c* and 18*d* are set to be smaller than the forward voltages of the diodes 18*a* and 18*b* so that the diodes 18*c* and 18*d* can be conducted with application of smaller voltages.

Further, the impedances of the first and second impedance circuits 28*a* and 28*b* vary with voltages developed across the second coil parts 3*c* and 3*d* and first and second impedance circuits, in such a manner that these diodes 18*a*, 18*b*, 18*c* and 18*d*, when applied with their forward voltages, produce constant voltages thereacross.

When the vertical deflection current Iv is positive and the screen upper part is subjected to the deflection, a large voltage during the vertical retrace causes an abnormal current containing pulses to appear in the positive side of the shunt current I1, but which abnormal current is suppressed by the action of the inductor 17. When the internal resistive value of the inductor 17 is optimumly set, the shunt current I2 flowing through the diode 18*b* can also be set to be linearly decreased. In the case where the vertical deflection current Iv is negative and the screen lower part is subjected to the vertical deflection, optimization of the resistive value of the fixed resistor 14*i* enables the negative amplitude of the shunt current I1 to be set at a predetermined value.

In such a prior art deflection yoke, the vertical deflection magnetic field 20 is of a stronger barrel shape as shown in FIG. 3A; whereas, in the present embodiment, the current flowing through the second coil parts 3*c* and 3*d* (hatched areas) is decreased by an amount corresponding to the shunt current I1 as shown in FIG. 3B only when the screen upper and lower parts are subjected to the vertical deflection, thus resulting in that the vertical deflection magnetic field 20 is of a weaker barrel shape. For this reason, the difference between the deflection force 21R acting on the electron beam 19R and the deflection force 21B acting on the electron beam 19B is decreased with respect to their horizontal, and vertical components.

It will be appreciated from the above that the horizontal line misconvergence 25*a* at the screen upper and lower parts can be corrected (see FIG. 22B) only through the decrease of the current flowing through the second coil parts 3*c* and 3*d* in the present embodiment of FIG. 3B, although the vertical deflection magnetic field 20 causes generation of the horizontal and vertical line misconvergences 25*a* and 26*b* (see FIG. 22A) at the screen upper and lower parts in such a prior art deflection yoke as shown in FIG. 3A. Further, since the vertical deflection magnetic field 20 is inflected as shown in FIG. 3B, a change in the vertical line misconvergence 26*b* at the left and right ends of the screen upper part is greater than a change in the vertical line misconvergence 26*b* at the center of the screen upper part, the vertical line misconvergences 26*a* and 26*b* can be made substantially equal at the left and right ends of the screen upper part and at the center of the screen upper part.

When the shunt current I1 flows, a difference between the currents flowing through the upper and lower side coil parts 7*a* and 7*b* of the vertical auxiliary deflection coil 7 is substantially equal to the shunt current I1. More specifically, the current flowing through the second coil parts 3*c* and 3*d* is substantially equally distributed always to the upper and lower side coil parts 7*a* and 7*b*. When the screen upper part is subjected to the vertical deflection, however, most of the shunt current I1 flowing through the second and fourth shunt circuits including the diodes 18*b* and 18*d* flows into the lower side coil part 7*b*, thus causing an imbalance between the currents flowing through the coil parts 7*a* and 7*b*. Similarly, when the screen lower part is subjected to the vertical deflection, most of the shunt current I1 flowing through the first and third shunt circuits including the diodes 18*a* and 18*c* flows into the upper side coil part 7*a*, thus causing an imbalance between the currents flowing through the coil parts 7*a* and 7*b*.

Therefore, when the screen upper part is subjected to the vertical deflection, the current flowing through the lower side coil part 7*b* is larger than the current flowing through the upper side core part 7*a*, so that, as shown in FIG. 8A, the vertical deflection magnetic field 20 made upwardly convex is developed and thus the deflection forces 21B and 21R act on the electron beams 19B and 19R in mutually divergent directions respectively. This is because the 4 polar components of the magnetic field generated by the upper side core part 7*a* of the vertical auxiliary deflection coil 7 are opposite in their direction to the 4 polar components of the magnetic field generated by the lower side coil part 7*b* and also these 4 magnetic field components are different in their strength.

When the screen lower part is subjected to the vertical deflection, the current flowing through the upper side core part 7*a* is larger than the current flowing through the lower side coil part 7*b* so that, as shown in FIG. 8B, the vertical deflection magnetic field 20 is of the downwardly convex shape and thus the deflection forces 21B and 21R act on the electron beams 19B and 19R in mutually divergent directions respectively.

Figure 22A:
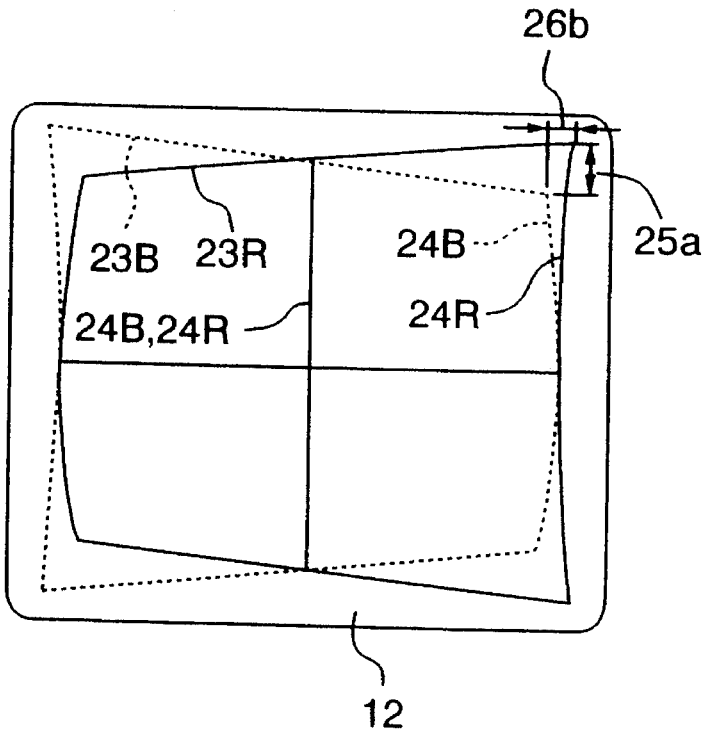
FIGS. 22A and 22B show convergence patterns for explaining the operation of the sixth embodiment of the deflection yoke in accordance with the present invention.
Figure 22B:
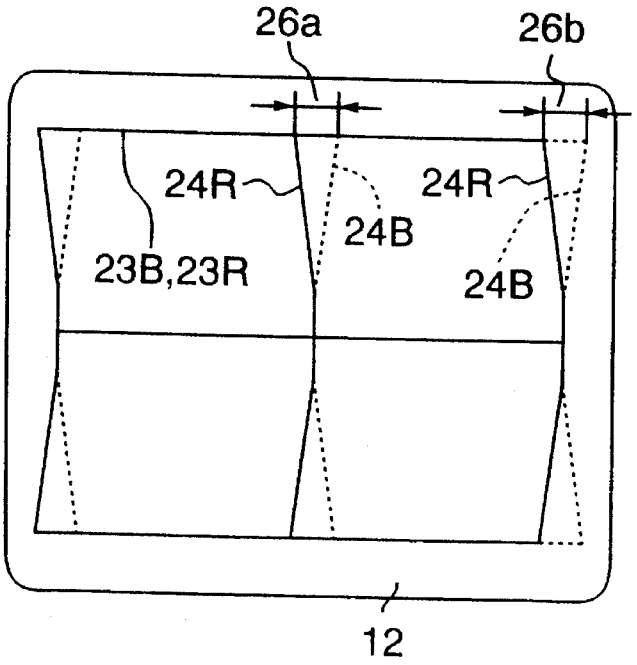
Figure 23A:
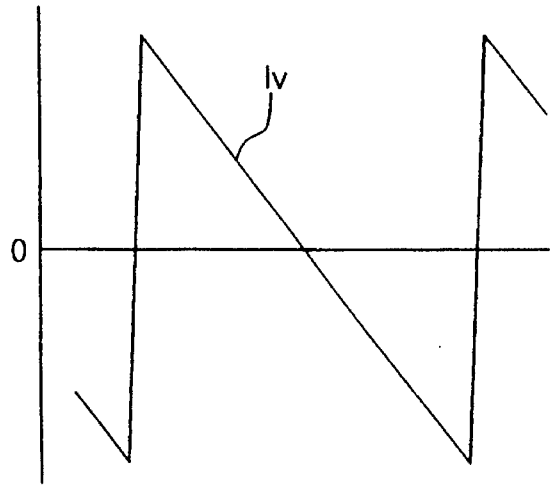
FIGS. 23A, 23B, 23C and 23D show diagrams of waveforms of a vertical deflection current and its shunt currents in FIG. 21.
Figure 23B:
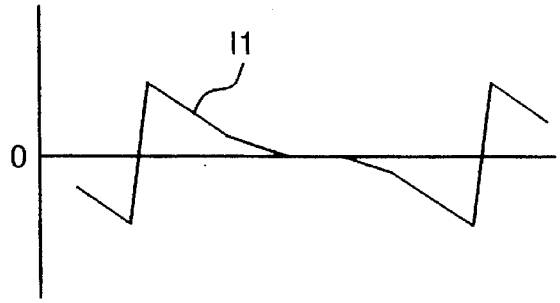
Figure 23C:
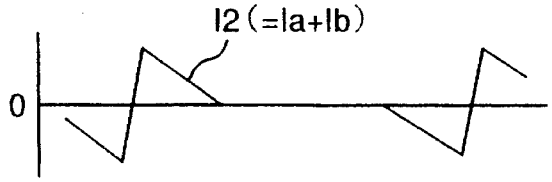
Figure 23D:
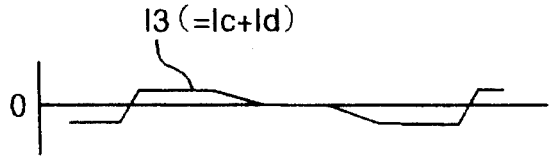

Thus, in the FIG. 22B, the vertical line 24R at the screen upper part based on the electron beam 19R is position-corrected rightwardly and the vertical line 24B based on the electron beam 19B is position-corrected leftwardly, so that the vertical line 24R coincides with the vertical line 24B, thus resulting in that the vertical line misconvergences 26*a* and 26*b* can be corrected.

As mentioned above, in the present embodiment, the horizontal line misconvergence 25*a* at the screen upper and lower parts can be corrected and the vertical line misconvergences 26*a* and 26*b* caused by this correction can be efficiently corrected.

In the present embodiment, further, when two stages of such shunt circuits having diodes are provided for the vertical deflection of the screen upper or lower part, the shunt current I1 can have a smooth waveform (which is preferably expressed ideally in the form of a curve of third order) when compared with the shunt current I2 in the case of one stage of such a shunt circuit having diodes as shown in FIG. 23, (c).

Figure 24A:
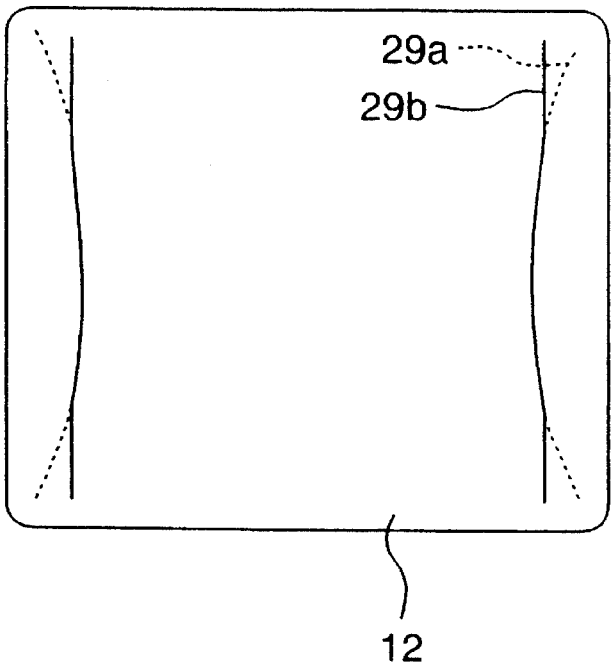
FIGS. 24A and 24B show left and right distortions for explaining the operation of the sixth embodiment of the deflection yoke in accordance with the present invention.
Figure 24B:
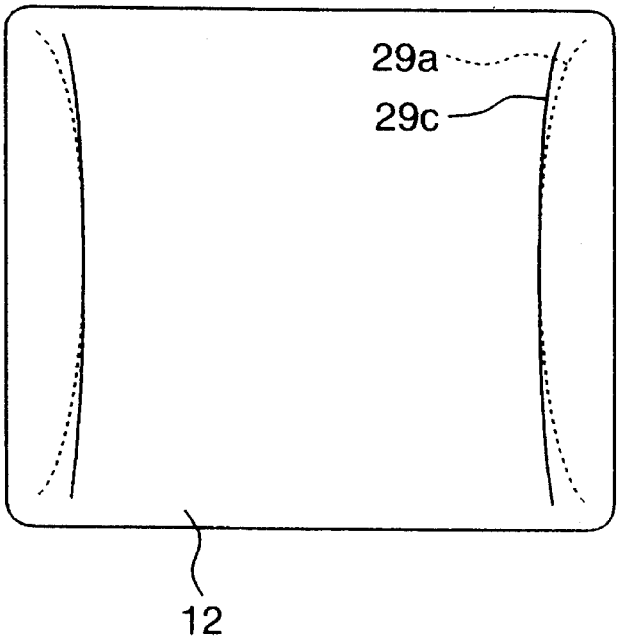

In the case of one stage of shunt circuit having diodes, as shown in FIG. 24A, when left/right distortions 29*b* after provision of the shunt circuit is compared with left/right distortions 29*a* before provision of the shunt circuit, pincushion distortions can be corrected only at ends of the screen upper and lower parts. In the present embodiment, on the other hand, as shown in FIG. 24B, left/right distortions 29*c* after provision of the shunt circuit can be corrected all over the screen and the pincushion distortion can be corrected without causing deterioration of the left/right distortions.

When the resistive values of the first and second impedance circuits 28*a* and 28*b* are set to have negative temperature coefficients, fluctuations in the operational characteristics of the diodes 18*a*, 18*b*, 18*c* and 18*d* caused by temperature change can be compensated for, thereby there can be realized a deflection yoke which has an excellent convergence performance with less temperature drift.

Figure 25:
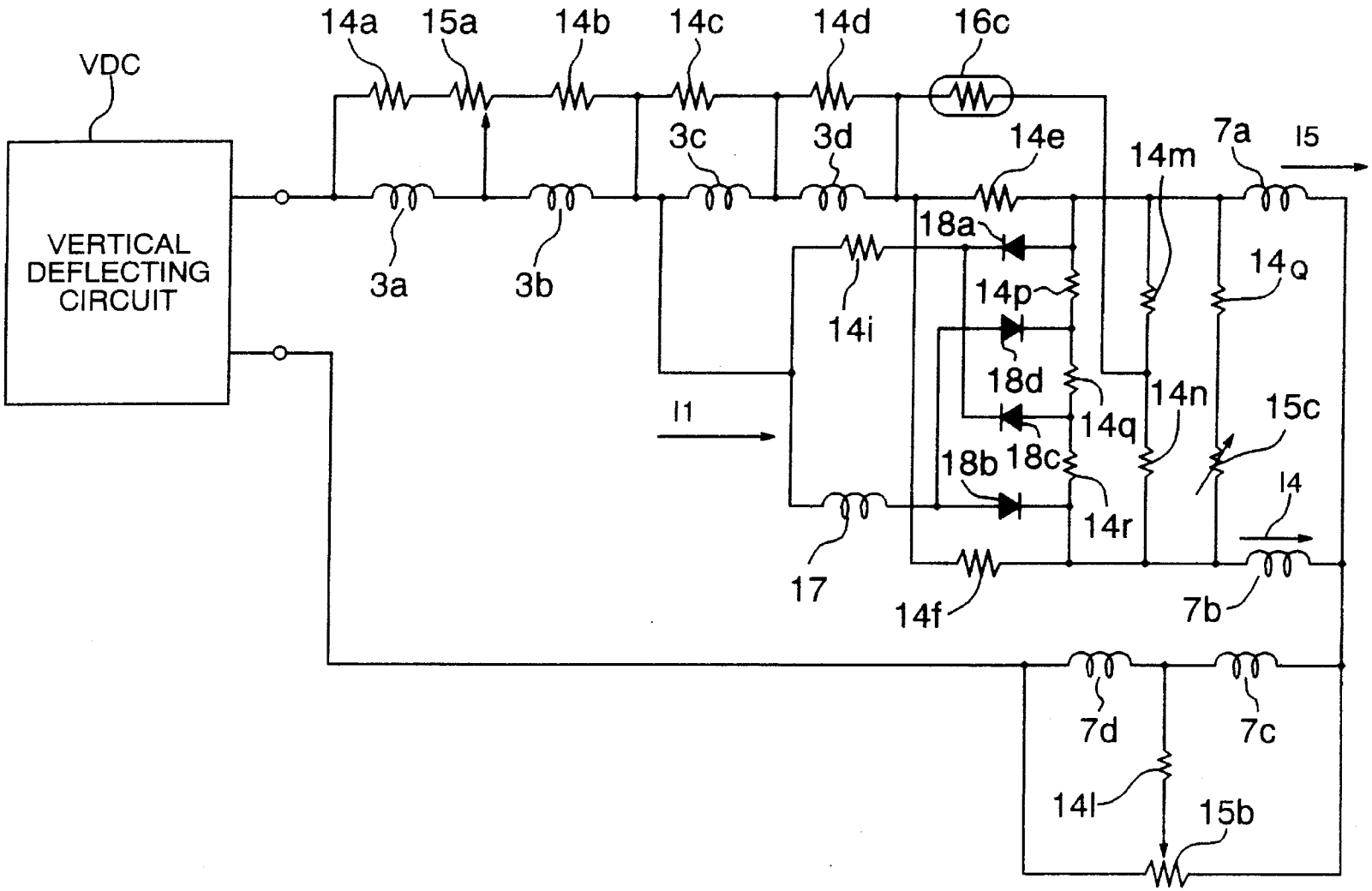
FIG. 25 is a circuit diagram of a deflection yoke in accordance with a seventh embodiment of the present invention.

Referring to FIG. 25, there is shown a circuit diagram of a vertical deflection system in a deflection yoke in accordance with a seventh embodiment of the present invention, which includes a thermistor 16*c*, fixed resistors 14*m* to 14*r* and a variable resistor 15*c*, and in which parts corresponding to those in FIG. 21 are denoted by the same reference numerals or symbols and explanation thereof is omitted to avoid double explanation.

The embodiment of FIG. 25 is different from the embodiment of FIG. 21 primarily in that a series circuit of the thermistor 16*a* and fixed resistor 14*g* as well as a series circuit of the thermistor 16*b* and fixed resistor 14*h* are deleted in FIG. 21; a series circuit of the fixed resistors 14*p*, 14*q* and 14*r*, a series circuit of the fixed resistors 14*m* and 14*n*, and a series circuit of the fixed and variable resistors 14*q* and 15*c* are connected in parallel between a junction point of the fixed resistor 14*e* and the upper side core part 7*a* of the vertical auxiliary deflection coil 7 and a junction point of the fixed resistor 14*f* and the lower side coil part 7*b* of the vertical auxiliary deflection coil 7; the thermistor 16*c* for temperature compensation is connected between a junction point of the fixed resistors 14*e* and 14*f* and a junction point of the fixed resistors 14*m* and 14*n*; the diode 18*d* is connected at its cathode to a junction point of the fixed resistors 14*p* and 14*q*; and the diode 18*c* is connected at its anode to a junction point of the fixed resistors 14*q* and 14*r*.

In the present embodiment, a series circuit of the upper side core part 7*a* and a first impedance circuit of the fixed resistors 14*e*, 14*m* and thermistor 16*c* is connected in parallel to a series circuit of the lower side coil part 7*b* and a second impedance circuit of the fixed resistors 14*f*, 14*n* and thermistor 16*c*. For this reason, only provision of the single thermistor 16*c* enables the resistive values of the first and second impedance circuits between their both ends to have negative temperature coefficients and also enables compensation of fluctuations in the operational characteristics of the diodes 18*a*, 18*b*, 18*c* and 18*d* caused by temperature change.

In the present embodiment, further, when the resistive value of the variable resistor 15*c* is adjusted, a difference between the currents flowing through the upper and lower side coil parts 7*a* and 7*b* of the vertical auxiliary deflection coil 7 can be changed while keeping substantially constant the amplitude of the shunt current I1 flowing through the diodes 18*a*, 18*b*, 18*c* and 18*d*.

In other words, when the resistive value of the variable resistor 15*d* is made extremely large, most of the shunt current flowing through the diode 18*b* flows into the lower side coil part 7*b*; whereas, when the resistive value of the variable resistor 15*c* is made zero, the current flowing through the diodes 18*a* and 18*b* flows substantially equally into the upper and lower side coil parts 7*a* and 7*b*. In this way, the difference (imbalance) between the currents flowing through the upper and lower side coil parts 7*a* and 7*b* varies depending on the resistive value of the variable resistor 15*c*.

The position of the vertical line 24R in the horizontal (left/right) direction and the position of the vertical line 24B in the horizontal direction in FIG. 22B vary with the difference of the currents flowing through the core parts 7*a* and 7*b*. When the resistive value of the variable resistor 15*c* is adjusted, corrections in the vertical line misconvergences 26*a* and 26*b* at the screen upper and lower parts can be adjusted simultaneously with respect to the screen upper and lower parts.

Figure 26A:
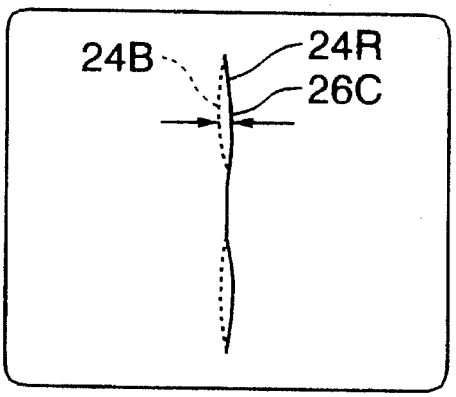
FIGS. 26A and 26B show convergence patterns for explaining the operation of the seventh embodiment of the deflection yoke in accordance with the present invention.
Figure 26B:
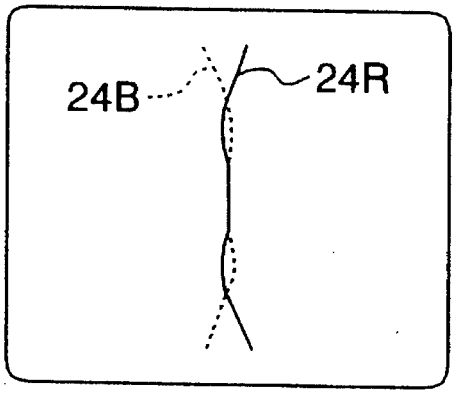
Figure 27:
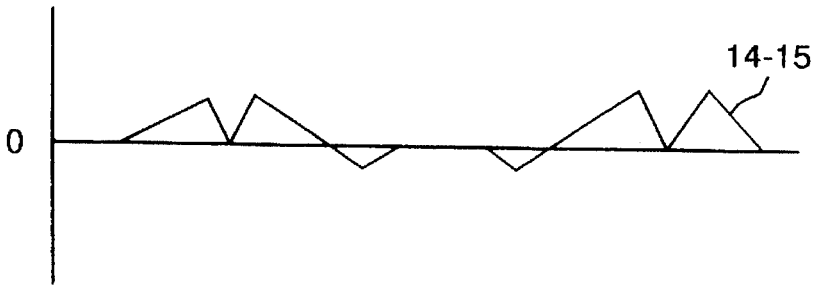
FIG. 27 shows a waveform of a current corresponding to a difference between lower and upper coils in FIG. 25.

The current flowing through the diode 18*c* flows more into the lower side coil part 7*b* than the upper side core part 7*a*; while the current flowing through the diode 18*d* flows more into the upper side core part 7*a* than the lower side coil part 7*b*. Accordingly, a difference (I4–I5) between a current I4 flowing through the lower side coil part 7*b* and a current I5 flowing through the upper side core part 7*a* has such a waveform as shown in FIG. 27. Thus, an imbalance takes place between the currents flowing through the upper and lower side coil parts 7*a* and 7*b*, causing a change in such a vertical misconvergence as shown in FIG. 26B. As a result, the component of such a vertical line misconvergence 26*c* as shown in FIG. 26B as well as the components of such vertical line misconvergences 26*a* and 26*b* as shown in FIG. 22B can be simultaneously corrected, thus realizing a deflection yoke which is excellent in convergence performance.

Figure 28:
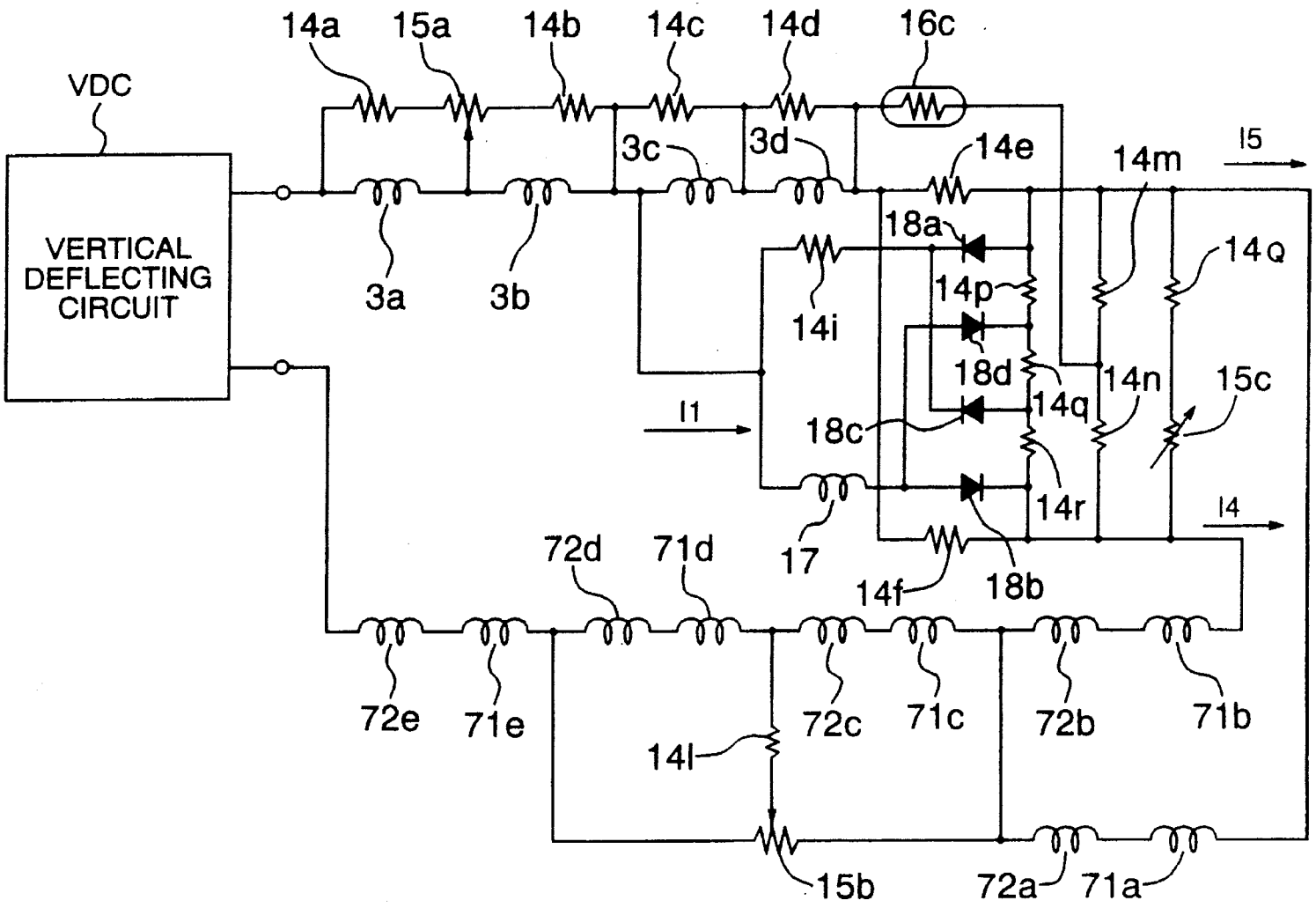
FIG. 28 is a circuit diagram of a deflection yoke in accordance with an eighth embodiment of the present invention.

FIG. 28 is a circuit diagram of a vertical deflection system in a deflection yoke in accordance with an eighth embodiment of the present invention, which includes the first upper side coil parts 71*a* and 72*a*, the first lower side coil parts 71*b* and 72*b*, the second upper side coil parts 71*c* and 72*c*, the second lower coil parts 71*d* and 72*d*, and the center coil parts 71*e* and 72*e*, and in which parts corresponding to those in FIG. 25 are denoted by the same reference numerals or symbols and explanation there is omitted.

In the present embodiment, as shown in FIG. 28, the upper side core part 7*a* in the embodiment of FIG. 25 is replaced by a series circuit of the first upper side coil parts

71*a* and 72*a;* the upper side coil part 7*c* in the embodiment of FIG. 25 is replaced by a series circuit of the second upper side coil parts 71*c* and 72*c;* the lower side coil part 7*b* in the embodiment of FIG. 25 is replaced by a series circuit of the first lower side coil parts 71*b* and 72*b;* the lower side coil part 7*d* in the embodiment of FIG. 25 is replaced by a series circuit of the second lower side coil parts 71*d* and 72*d;* and a series circuit of the center coil parts 71*e* and 72*e* is connected between the vertical deflection circuit VDC and a junction point of the second lower coil part 72*d* and variable resistor 15*b*. Other arrangement is substantially the same as that of FIG. 5.

FIG. 15 corresponds to a rear view of the vertical auxiliary deflection coil 7 in the present embodiment.

With such an arrangement as mentioned above, as in the embodiment of FIG. 21, the action of the shunt current causes the vertical deflection magnetic field 20 of an upwardly convex shape to be generated during the vertical deflection of the screen upper part so that the deflection forces 21B and 21R act on the electron beams 19B and 19R in mutually divergent directions as shown in FIG. 16A; whereas, the action of the shunt current causes the vertical deflection magnetic field 20 of a downwardly convex shape to be generated during the vertical deflection of the screen lower part so that the deflection forces 21B and 21R act on the electron beams 19B and 19R in mutually divergent directions as shown in FIG. 16B. As a result, such a horizontal line misconvergence 25*a* at the screen upper and lower parts as shown in FIG. 22A can be corrected, and such vertical line misconvergences 26*a* and 26*b* caused by the horizontal line misconvergence as shown in FIG. 22B can also be corrected. Further, the center coil parts 71*e* and 72*e* cause generation of the 2 polar magnetic field, whereby the landing conditions of the electron beams on the phosphor screen 12 can be changed and the upper/lower pincushion distortions can be corrected.

As has been explained in the foregoing, in accordance with the present invention, the following effects can be achieved.

That is, by shunting the current flowing through one of the coil division parts of the vertical deflection coil only during the deflection of the screen upper and lower parts, the barrel shape of the vertical deflection magnetic field can be made weaker to correct the horizontal line misconvergence at the screen upper and lower parts. By passing the above shunt current to cause imbalance between the currents flowing through the upper and lower side coil parts of the vertical deflection coil, further, the vertical line misconvergence caused by the above correction of the horizontal line misconvergence can also be corrected simultaneously.

Further, when the position of one of 3 or more coil division parts of the vertical deflection coil is arbitrarily set so that the current flowing through the coil part in question is shunted only during the deflection of the screen upper and lower parts to be decreased, the barrel shape of the vertical deflection magnetic field is made weaker, whereby the horizontal line misconvergence at the screen upper and lower parts can be corrected, the vertical line misconvergence caused by the correction of the horizontal line misconvergence can also be corrected at the center of the screen upper and lower parts, and simultaneously the vertical line misconvergence at the left and right ends of the screen upper and lower parts.

Furthermore, when the current flowing through one of coil division parts of the vertical deflection coil is decreasedly shunted by a plurality of stages of shunt circuits during the vertical deflection of the screen, the barrel shape of the vertical deflection magnetic field is made weaker, whereby the horizontal line misconvergence at the screen upper and lower parts can be corrected without causing deterioration of the left/right distortions. When the above shunted current is passed to cause imbalance between the currents flowing through the upper and lower side coil parts of the vertical auxiliary deflection coil, the vertical line misconvergence caused by the above correction of the horizontal line misconvergence can be corrected.

In addition, when part of the shunted current is used to provide vertical line correction in a predetermined direction (e.g., in a right direction of the blue vertical line with respect to the red vertical line), the vertical line misconvergence appearing between the screen upper and lower parts and the screen center.

When a single variable resistor is adjusted, corrections in the vertical line misconvergences at the screen upper and lower parts can be corrected at the same time.

In accordance with the present invention, therefore, there can be implemented a deflection yoke which is excellent in the convergence performances to both of the horizontal and vertical lines with use of a relatively simple arrangement.

What is claimed is:

1. A deflection yoke for use in a color cathode-ray tube having an electron gun for generating a multiplicity of electron beams in an inline array, comprising:

horizontal and vertical deflection coils; and a main core, wherein the vertical deflection coil is made up of at least a pair of saddle shaped coil halves each divided into at least 2 first and second coil parts, the first coil parts of the coil halves and the second coil parts thereof are connected respectively in series or in parallel, a subcore having a vertical auxiliary deflection coil is provided on a side of the electron gun, the vertical auxiliary deflection coil includes a first auxiliary coil for generating at least 4 polar magnetic field components and a second auxiliary coil for generating 4 polar magnetic field components directed opposite to the 4 polar magnetic field components of the first auxiliary coil, a series circuit of a first resistor and the first correction coil is connected in parallel to a series circuit of a second resistor and the second correction coil to form a parallel circuit, the parallel circuit is connected in series with the vertical deflection coil, and a shunt circuit is provided for shunting part of a vertical deflection current flowing through the second coil part of the coil halves when the vertical deflection current is equal to or higher than a constant value to cause a predetermined imbalance between currents flowing through the first and second correction coils according to the vertical deflection current.

2. A deflection yoke as set forth in claim 1, wherein each of said coil halves has a centertap for division thereof into said first and second coil parts.

3. A deflection yoke as set forth in claim 1, wherein said first correction coil is disposed in an upper side of said color cathode-ray tube with respect to a center axis thereof, and said second correction coil is disposed in a lower side of said color cathode-ray tube with respect to the center axis thereof.

4. A deflection yoke as set forth in claim 1, wherein said series circuit includes a first shunt circuit connected in parallel to a first series circuit of the second coil part of said coil halves and said first resistor for changing an impedance of said first shunt circuit according to a voltage developed across said first series circuit and also includes a second shunt circuit connected in parallel to a second series circuit of the second coil part of said coil halves and said second resistor for changing an impedance of said second shunt circuit according to a voltage developed across said second series circuit.

5. A deflection yoke as set forth in claim 1, wherein an impedance circuit having a negative temperature coefficient is provided between said second coil part of the coil halves and said parallel circuit.

6. A deflection yoke as set forth in claim 1, wherein an adjustable variable resistor is provided between a junction point of said first resistor and first correction coil and a junction point of said second resistor and second correction coil.

7. A deflection yoke for use in a color cathode-ray tube having an electron gun for generating a multiplicity of electron beams in an inline array, comprising:

horizontal and vertical deflection coils; and a main core, wherein the vertical deflection coil is made up of at least a pair of saddle shaped coil halves each divided into at least 3 first, second and third coil parts, the second coil parts of the coil halves are disposed between said first and third coil parts, a series circuit of said first coil part of the respective coil halves and said third coil part is connected in series with the second coil part of the coil halves, and a shunt circuit is provided for shunting part of a vertical deflection current flowing through the second coil part of the coil halves when the vertical deflection current is equal to or higher than a constant value.

8. A deflection yoke as set forth in claim 7, wherein a subcore having a vertical auxiliary deflection coil is provided on a side of said electron gun, said vertical auxiliary deflection coil includes a first correction coil for generating at least 4 polar magnetic field components and a second correction coil for generating 4 polar magnetic field components directed opposite to the 4 polar magnetic field components of said first correction coil, a series circuit of a first resistor and said first correction coil is connected in parallel to a series circuit of a second resistor and said second correction coil to form a parallel circuit, said parallel circuit is connected in series with said vertical deflection coil, and said shunt circuit has a function of causing an imbalance of currents flowing through said first and second correction coils according to the vertical deflection current.

9. A deflection yoke as set forth in claim 7, wherein a subcore having a vertical auxiliary deflection coil is provided on a side of said electron gun, said vertical auxiliary deflection coil includes a first correction coil for generating at least 4 polar magnetic field components and a second correction coil for generating 4 polar magnetic field components directed opposite to the 4 polar magnetic field components of said first correction coil, a series circuit of a first resistor and said first correction coil is connected in parallel to a series circuit of a second resistor and said second correction coil to form a parallel circuit, said parallel circuit is connected in series with said vertical deflection coil, and each of said coil halves has a centertap for division thereof into first, second and third coil parts.

10. A deflection yoke as set forth in claim 7, wherein said series circuit includes a first shunt circuit connected in parallel to a first series circuit of the second coil part of said coil halves and said first resistor for changing an impedance of said first shunt circuit according to a voltage developed across said first series circuit and also includes a second shunt circuit connected in parallel to a second series circuit of the second coil part of said coil halves and said second resistor for changing an impedance of said second shunt circuit according to a voltage developed across said second series circuit.

11. A deflection yoke as set forth in claim 7, wherein an impedance circuit having a negative temperature coefficient is provided between said second coil part of the coil halves and said parallel circuit.

12. A deflection yoke as set forth in claim 1, wherein an impedance circuit having a negative temperature coefficient comprising a thermistor and a resistor is provided between said second coil part of the coil halves and said parallel circuit.

13. A deflection yoke as set forth in claim 7, wherein an impedance circuit having a negative temperature coefficient comprising a thermistor and a resistor is provided between said second coil part of the coil halves and said parallel circuit.

14. A deflecting yoke as set forth in claim 1, wherein said shunt circuit is arranged to form a pair of closed circuits including a plurality of diodes.

15. A deflecting yoke as set forth in claim 7, wherein said shunt circuit is arranged to form a pair of closed circuits including a plurality of diodes.

16. A deflection yoke for use in a color cathode-ray tube having an electron gun for generating a multiplicity of electron beams in an inline array, comprising:

horizontal and vertical deflection coils; and a main core, wherein the vertical deflection coil is made up of at least a pair of saddle shaped coil halves each divided into at least 2 first and second coil parts, the first coil parts of the coil halves and the second coil parts thereof are connected respectively in series or in parallel, a subcore having a vertical auxiliary deflection coil is provided on a side of the electron gun, the vertical auxiliary deflection coil includes a first auxiliary coil for generating at least 4 polar magnetic field components and a second auxiliary coil for generating 4 polar magnetic field components directed opposite to the 4 polar magnetic field components of the first auxiliary coil, a series circuit of a first impedance circuit and said first correction coil is connected in parallel to a series circuit of a second impedance circuit and said second correction coil to form a parallel circuit, said parallel circuit is connected in series with said vertical deflection coil, a first shunt circuit is provided for shunting part of a vertical deflection current flowing through the second coil part of the coil halves and said first impedance circuit when the vertical deflection current is equal to or higher than a first predetermined value and flows in a first direction, a second shunt circuit is provided for shunting part of a vertical deflection current flowing through the second coil part of the coil halves and said second impedance circuit when the vertical deflection current is equal to or higher than the first predetermined value and flows in a direction opposite to said first direction, a third shunt circuit is provided for shunting part of a vertical deflection current flowing through the second coil part of the coil halves and said first or second impedance circuit when the vertical deflection current is equal to or higher than a second predetermined value and flows in said first direction, a fourth shunt circuit is provided for shunting part of a vertical deflection current flowing through the second coil part of the coil halves and said first or second impedance circuit when the vertical deflection current is equal to or higher than the second predetermined value and flows in a direction opposite to said first direction, and a shunt control circuit is provided having a function of causing a predetermined imbalance between the currents flowing through the first and second correction coils according to the vertical deflection current.

17. A deflection yoke as set forth in claim 16, wherein each of said coil halves has a centertap for division thereof into said first and second coil parts.

18. A deflection yoke as set forth in claim 16, wherein said first correction coil is disposed in an upper side of said color cathode-ray tube with respect to a center axis thereof, and said second correction coil is disposed in a lower side of said color cathode-ray tube with respect to the center axis thereof.

19. A deflection yoke as set forth in claim 16, wherein a plurality of resistors are connected in series between a junction point of said first impedance circuit and first correction coil and a junction point of said second impedance circuit and second correction coil to form a resistor series circuit, one or more intermediate junction points are provided between the resistors of said resistor series circuit having 2 terminals, one of 2 connection terminals of said first shunt circuit is connected one end of said second coil part of the coil halves while the other connection terminal is connected to one terminal of said resistor series circuit, one of 2 connection terminals of said second shunt circuit is connected one end of said second coil part of the coil halves while the other connection terminal is connected to the other terminal of said resistor series circuit, one of 2 connection terminals of said third shunt circuit is connected one end of said second coil part of the coil halves while the other connection terminal is connected to one of the intermediate connection points of said resistor series circuit, and one of 2 connection terminals of said fourth shunt circuit is connected one end of said second coil part of the coil halves while the other connection terminal is connected to one of the intermediate connection points of said resistor series circuit.

20. A deflection yoke as set forth in claim 16, wherein said first and second impedance circuits, have resistive values having negative temperature coefficients, and said first, second, third and fourth shunt circuits are arranged respectively to form a closed circuit having diodes.

21. A deflection yoke as set forth in claim 16, wherein each of said first and second impedance circuits includes a thermistor and a resistor.

22. A deflection yoke for use in a color cathode-ray tube having an electron gun for generating a multiplicity of electron beams in an inline array, comprising:

horizontal and vertical deflection coils; and a main core, wherein a subcore having a vertical auxiliary deflection coil is provided on a side of the electron gun, the vertical auxiliary deflection coil includes a first auxiliary coil for generating at least 4 polar magnetic field components and a second auxiliary coil for generating 4 polar magnetic field components directed opposite to the 4 polar magnetic field components of the first auxiliary coil, a series circuit of a first impedance circuit and said first correction coil is connected in parallel to a series circuit of a second impedance circuit and said second correction coil to form a parallel circuit, said parallel circuit is connected in series with said vertical deflection coil, a first shunt circuit is provided for shunting part of a vertical deflection current flowing through said first impedance circuit when the vertical deflection current is equal to or higher than a predetermined constant value and flows in a first direction, a second shunt circuit is provided for shunting part of a vertical deflection current flowing through said second impedance circuit in a direction opposite to said second impedance circuit when the vertical deflection current is equal to or higher than the predetermined constant value and flows in a direction opposite to said first direction, a shunt control circuit is provided having a function of causing a predetermined imbalance between the currents flowing through the first and second correction coils according to the vertical deflection current, and a variable resistor is connected between a junction point of the first impedance circuit and first correction coil and a junction point of said second impedance circuit and second correction coil.

23. A color cathode-ray tube apparatus comprising a color cathode-ray tube having an electron gun for generating a multiplicity of electron beams in an inline array, wherein the deflection yoke as set forth in claim 1 is provided in said color cathode-ray tube.

24. A color cathode-ray tube apparatus comprising a color cathode-ray tube having an electron gun for generating a multiplicity of electron beams in an inline array, wherein the deflection yoke as set forth in claim 7 is provided in said color cathode-ray tube.

25. A color cathode-ray tube apparatus comprising a color cathode-ray tube having an electron gun for generating a multiplicity of electron beams in an inline array, wherein the deflection yoke as set forth in claim 16 is provided in said color cathode-ray tube.

26. A color cathode-ray tube apparatus comprising a color cathode-ray tube having an electron gun for generating a multiplicity of electron beams in an inline array, wherein the deflection yoke as set forth in claim 22 is provided in said color cathode-ray tube.

* * * * *